US007178531B2

(12) United States Patent
Carballada et al.

(10) Patent No.: US 7,178,531 B2
(45) Date of Patent: Feb. 20, 2007

(54) DEVICE FOR ACHIEVING SMOOTH AND STRAIGHT HAIR

(75) Inventors: Jose Antonio Carballada, Cincinnati, OH (US); Dennis Eugene Kuhlman, Middletown, OH (US); David Michael Stentz, Cincinnati, OH (US); Shinji Nishimura, Hikone (JP); Kazunori Nakasai, Hikone (JP)

(73) Assignee: The Procter & Gamble Company, Cincinnati, OH (US)

( * ) Notice: Subject to any disclaimer, the term of this patent is extended or adjusted under 35 U.S.C. 154(b) by 680 days.

(21) Appl. No.: 10/603,977

(22) Filed: Jun. 25, 2003

(65) Prior Publication Data

US 2004/0000319 A1 Jan. 1, 2004

Related U.S. Application Data

(63) Continuation of application No. PCT/US02/20127, filed on Jun. 26, 2002.

(51) Int. Cl.
*A45D 1/00* (2006.01)
*A45D 1/02* (2006.01)
*A45D 6/06* (2006.01)

(52) U.S. Cl. ..... 132/224; 132/227; 132/228

(58) Field of Classification Search ..... 132/224, 132/227, 228, 229, 232, 272, 269; 219/222–225
See application file for complete search history.

(56) References Cited

U.S. PATENT DOCUMENTS

| | | | |
|---|---|---|---|
| 4,034,201 | A | 7/1977 | Walter |
| 4,503,317 | A | 3/1985 | Mancillas |
| 5,365,953 | A | 11/1994 | Feughelman |
| 5,857,470 | A | 1/1999 | Schmidt |
| 6,056,946 | A | 5/2000 | Crudele et al. |
| 6,199,558 | B1 | 3/2001 | Schmidt |
| 6,325,072 | B1 | 12/2001 | Smetana |
| 6,397,855 | B1 | 6/2002 | Dumler |

FOREIGN PATENT DOCUMENTS

| | | |
|---|---|---|
| JP | 48-16751 | 5/1973 |
| JP | 52-78559 | 7/1977 |
| JP | 53-9673 | 1/1978 |
| JP | 55-70208 | 5/1980 |
| JP | 61-2806 | 1/1986 |

(Continued)

*Primary Examiner*—John J. Wilson
*Assistant Examiner*—Robyn Doan
(74) *Attorney, Agent, or Firm*—Linda M. Sivik; Tara M. Rosnell

(57) ABSTRACT

A hair styling device for smoothing and straightening hair strands on a scalp region, comprising, in combination: two hingedly attached, movably opposed arms each of said arms comprising a hair strand gripping means; heating means incorporated into the gripping means for providing heat to the hair strands; a reservoir in fluid communication with a means of delivery of the gripping means which delivers a nonvolatile styling active delivered as droplets having a Dv(90) of less than about 30 microns. A method for straightening hair strands on a scalp region wherein hair to be straightened is passed under tension between a gripping means, wherein the gripping means provides a heating means, and a styling active comprising nonvolatile compounds, wherein the styling active is delivered as droplets having a Dv(90) of less than about 30 microns.

53 Claims, 16 Drawing Sheets

FOREIGN PATENT DOCUMENTS

| | | | |
|---|---|---|---|
| JP | 62-104701 | | 7/1987 |
| JP | 62-199159 | | 12/1987 |
| JP | 61-157404 | | 9/1989 |
| JP | 17-72447 | | 10/1989 |
| JP | 2541865 | | 6/1993 |
| JP | 5-309011 | | 11/1993 |
| JP | 7-12004 | | 2/1995 |
| JP | 7-12005 | | 2/1995 |
| JP | 08-080215 | A | 3/1996 |
| JP | 2000-135111 | | 5/2000 |
| JP | 2000-157322 | A | 6/2000 |
| JP | 2000-166634 | | 6/2000 |
| JP | 2000-175728 | | 6/2000 |
| WO | WO-98/07345 | A1 | 2/1998 |
| WO | WO-99/13843 | A1 | 3/1999 |
| WO | WO-99/45814 | A1 | 9/1999 |
| WO | WO-03/077702 | A2 | 9/2003 |

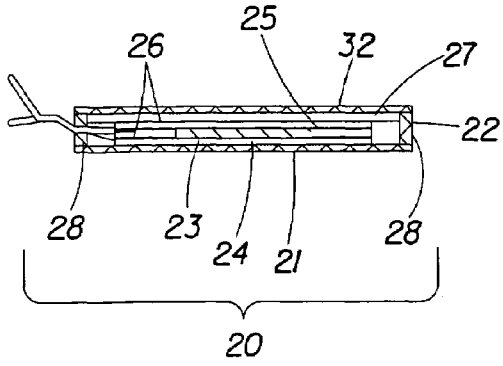
Fig. 5A
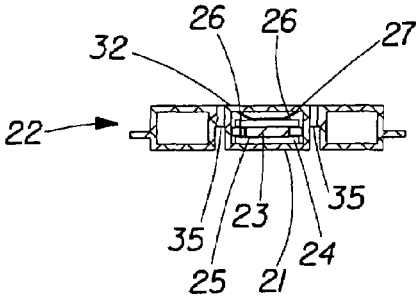
Fig. 5B
Fig. 5C
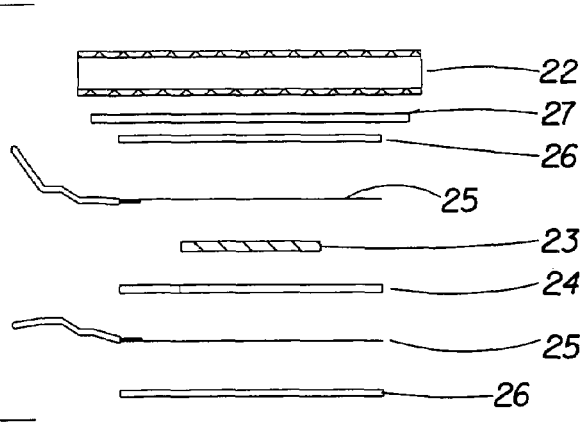
Fig. 5D
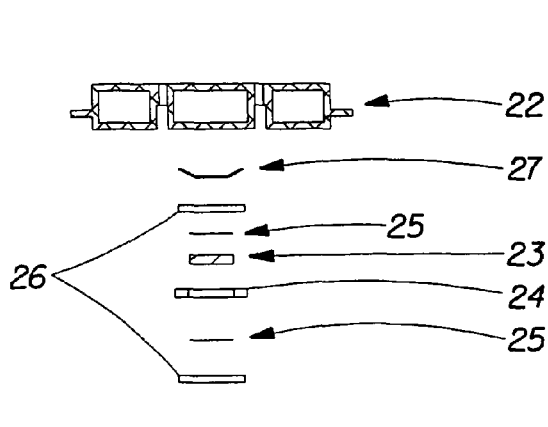

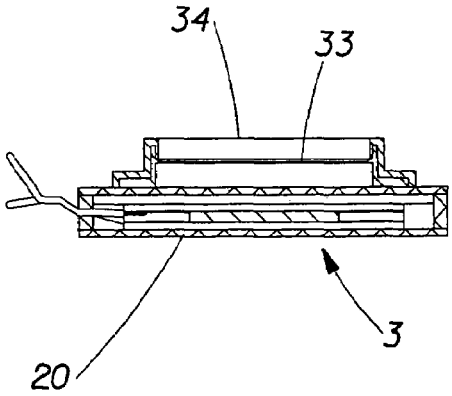
Fig. 6A
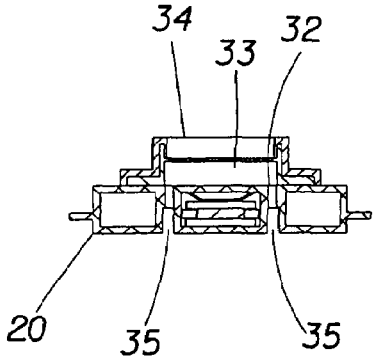
Fig. 6B
Fig. 6C
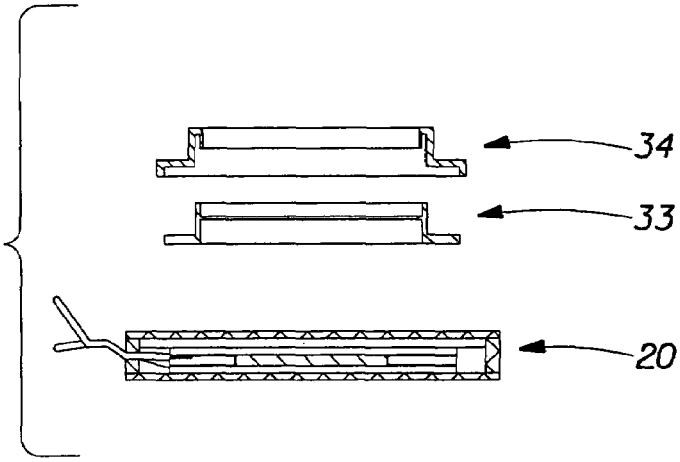
Fig. 6D
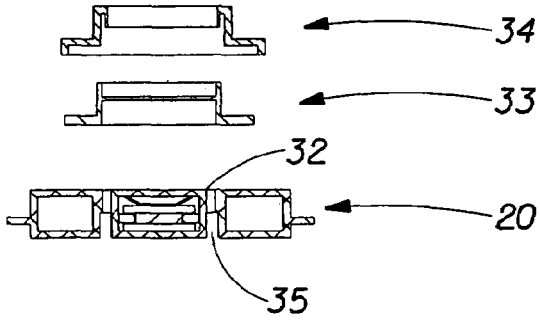

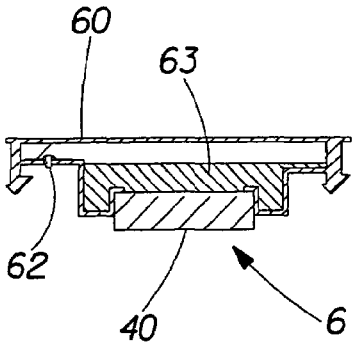
Fig. 11A
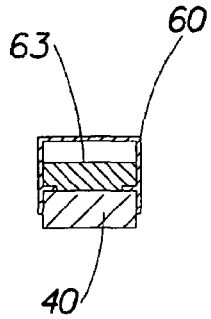
Fig. 11B
Fig. 11C
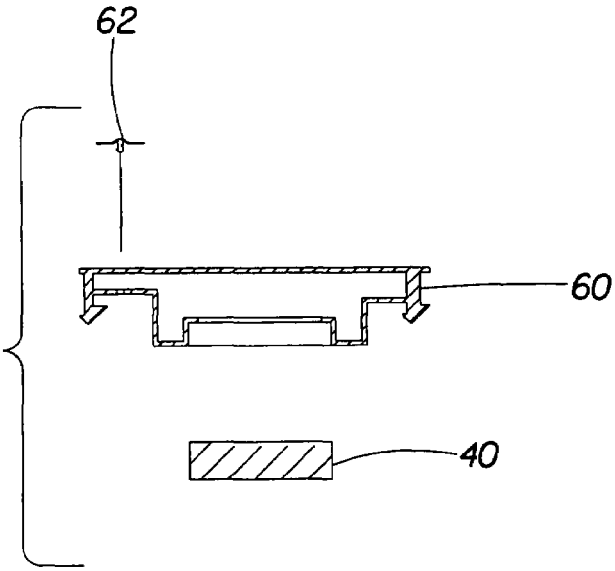
Fig. 11D
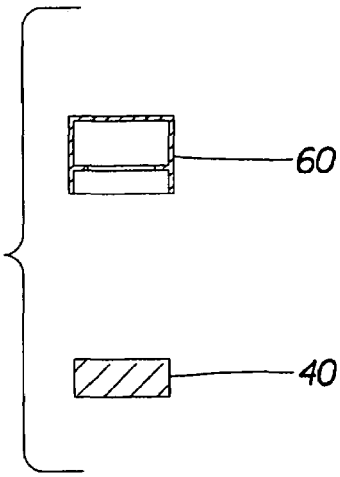

DEVICE FOR ACHIEVING SMOOTH AND STRAIGHT HAIR

CROSS REFERENCE TO RELATED APPLICATION

The application is a continuation of International application PCT/US02/20127 (Case 8982F&) filed on Jun. 26, 2002.

FIELD OF THE INVENTION

This invention relates to hair styling devices, particularly to a hair styling device capable of using a non-volatile styling active in combination with heat and tension to produce a smooth and straight appearance to the hair.

BACKGROUND OF THE INVENTION

The use of steam for setting or styling hair is well known and many attempts have been made to provide devices such as hair rollers, curling irons and flat irons with structures to emit steam to improve the results obtained in curling, straightening, and setting hair with the aid of heat.

Attempts in the past have included using some type of active which is volatile in a hair styling device. However, the result of using an active which is a volatile ingredient is that it results in delivering a very limited and not long-lasting through the day hair style.

It has now surprisingly been found that the delivery of non-volatile actives from a hair styling device can allow for better and more even coverage on the hair. This approach allows for the delivery of a thin layer of active on the hair and results in a long-lasting hair style throughout the day. This approach also eliminates the problems associated with the use of styling product forms such as mousses, gels and sprays which results in large clumps of active (localized deposition) and less even coverage. It has also surprisingly been found that the use of moisture delivered in combination with the styling active and heat will improve the benefit of reshaping and restyling of the hair. Further, the use of water may aid to ease hair shaping and aid in even distribution of a styling active.

SUMMARY OF THE INVENTION

The present invention is directed to a hair styling device for smoothing and straightening hair strands on a scalp region, comprising, in combination: two hingedly attached, movably opposed arms each of said arms comprising a hair strand gripping means; heating means incorporated into the gripping means for providing heat to the hair strands; a reservoir in fluid communication with a means of delivery of the gripping means which delivers a nonvolatile styling active delivered as droplets having a Dv(90) of less than about 30 microns.

The present invention is further directed to the use of water to ease hair shaping and aid in even distribution of a styling active. The present invention is further directed to a method for straightening hair strands on a scalp regions wherein hair to be straightened is passed under tension between a gripping means, wherein the gripping means provides a heating means, and a styling active comprising nonvolatile compounds, wherein the styling active is delivered as droplets having a Dv(90) of less than about 30 microns.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify like elements and wherein:

FIG. 5A is a longitudinal cross-sectional view of a heating means according to the present invention.

FIG. 5B is a transverse cross-sectional view of a heating means according to the present invention.

FIG. 5C is an exploded longitudinal cross-sectional view of a heating means according to the present invention.

FIG. 5D is an exploded transverse cross-sectional view of a heating means according to the present invention.

FIG. 6A is a longitudinal cross-sectional view of a means of delivery according to the present invention.

FIG. 6B is a transverse cross-sectional view of a means of delivery according to the present invention.

FIG. 6C is an exploded longitudinal cross-sectional view of a means of delivery according to the present invention.

FIG. 6D is an exploded transverse cross-sectional view of a means of delivery according to the present invention.

FIG. 11A is a longitudinal cross-sectional view of an embodiment of the present invention comprising a non-refillable cartridge.

FIG. 11B is a transverse cross-sectional view of an embodiment of the present invention comprising a non-refillable cartridge.

FIG. 11C is an exploded longitudinal cross-sectional view of an embodiment of the present invention comprising a non-refillable cartridge.

FIG. 11D is an exploded transverse cross-sectional view of an embodiment of the present invention comprising a non-refillable cartridge.

DETAILED DESCRIPTION OF THE INVENTION

All documents cited are, in relevant part, incorporated herein by reference; the citation of any document is not to be construed as an admission that it is prior art with respect to the present invention.

All ratios are weight ratios unless specifically stated otherwise.

Except as otherwise noted, all amounts including quantities, percentages, portions, and proportions, are understood to be modified by the word "about", and amounts are not intended to indicate significant digits.

Except as otherwise noted, the articles "a", "an", and "the" mean "one or more" The present invention can comprise, consist of, or consist essentially of the essential elements and limitations of the invention described herein, as well any of the additional or optional ingredients, components, or limitations described herein.

All percentages, parts and ratios are based upon the total weight of the compositions of the present invention, unless otherwise specified. All such weights as they pertain to listed ingredients are based on the active level and, therefore, do not include carriers or by-products that may be included in commercially available materials. Herein, "molecular weight" means weight average molecular weight, unless specifically stated otherwise.

The components, including those, which may optionally be added, of the methods of the present invention, as well as methods for preparation, and methods for use, are described in detail below.

Other advantages and novel features of the present invention will become apparent to those skilled in the art from the following detailed description, which simply illustrates various modes contemplated for carrying out the invention. As will be realized, the invention is capable of other different aspects, all without departing from the spirit and scope of the invention. Accordingly, the drawings and descriptions are illustrative in nature and not restrictive.

Reference will now be made in detail to various exemplary embodiments of the invention, several of which are also illustrated in the accompanying drawings, wherein like numerals indicated the same elements throughout the views.

Figure 1A:
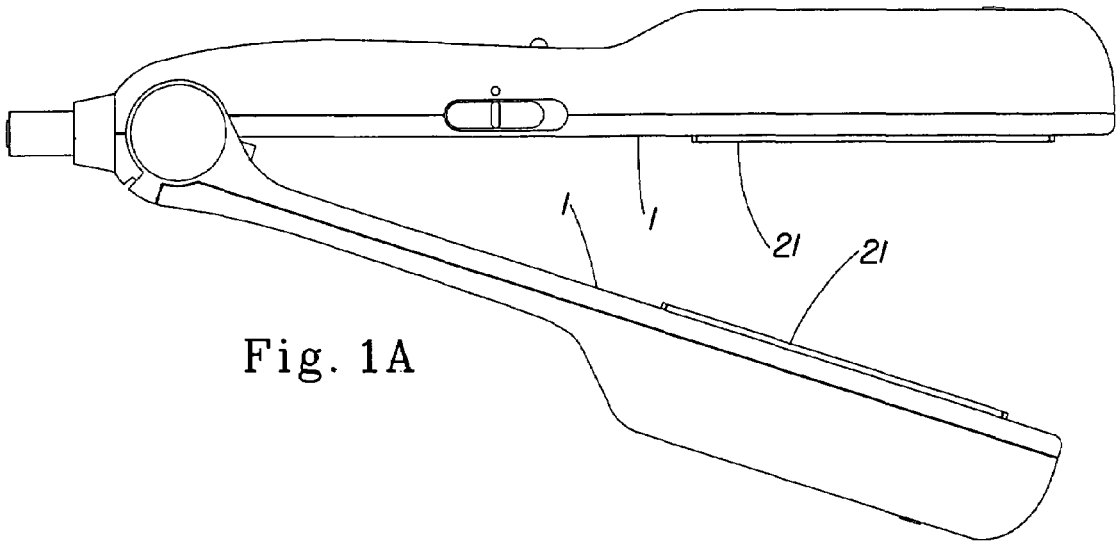
FIG. 1A is a side perspective view of a hair styling device according to the present invention comprising a gripping means.
Figure 1B:
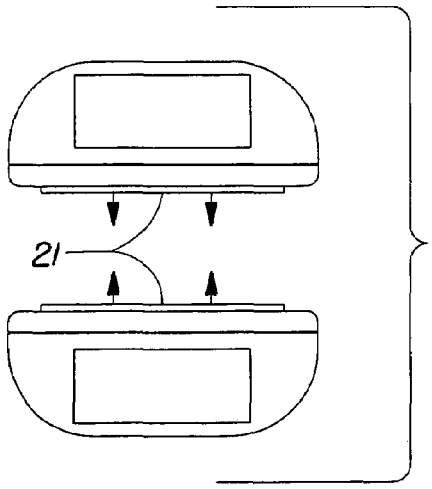
FIG. 1B is a front perspective view of a hair styling device according to the present invention comprising a gripping means.

FIGS. 1A and 1B depicts non-limiting exemplary embodiment of a hair styling device of the present invention comprising a gripping means (1) comprising arms that can be hinged at one end and can be opened by the force of spring as hinged end is the fulcrum. The gripping means (1) may be comprised of two hingedly attached, movably opposed, manually graspable arms for releasably gripping hair strands so that longitudinal tension can be applied thereto. A heating plate (21) is arranged in area of the gripping means (1) that will be in contact with hair. The gripping means (1) further comprises a pin (11) and a switch (77). The angle of the gripping means (1) opened is suitable to insert partition of hair between the arms and suitable for gripping the device. A partition of hair can be the gathering of a section or segment of hair strands.

Figure 2A:
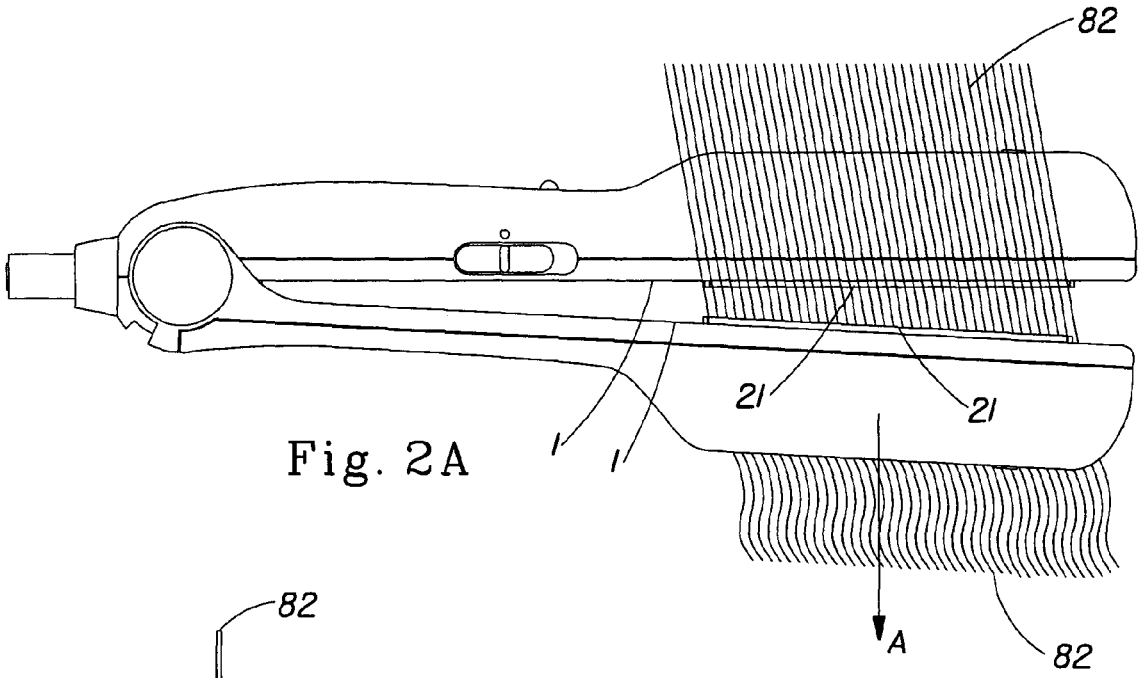
FIG. 2A is a perspective side view showing the use of a hair styling device according to the present invention, showing wavy hair after being straightened by passage under tension between the gripping means in the direction of line A.
Figure 2B:
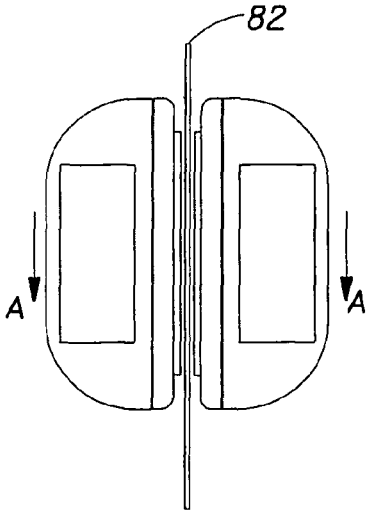
FIG. 2B is a perspective front view showing the use of a hair styling device according to the present invention wherein hair to be straightened is passed under tension between a gripping means in the direction of line A.

FIGS. 2A and 2B depicts a non-limiting exemplary embodiment of a hair styling device of the present invention demonstrating the use of a hair styling device showing wavy hair after being straightened by passage under tension between the gripping means (1) in the direction of line A. FIGS. 2A and 2B depict a gripping means (1) comprising a heating plate (21), a pin 11), and a switch (77), wherein a partition of hair (82) is straightened perpendicular against the orientation of the gripping means (1).

Figure 3A:
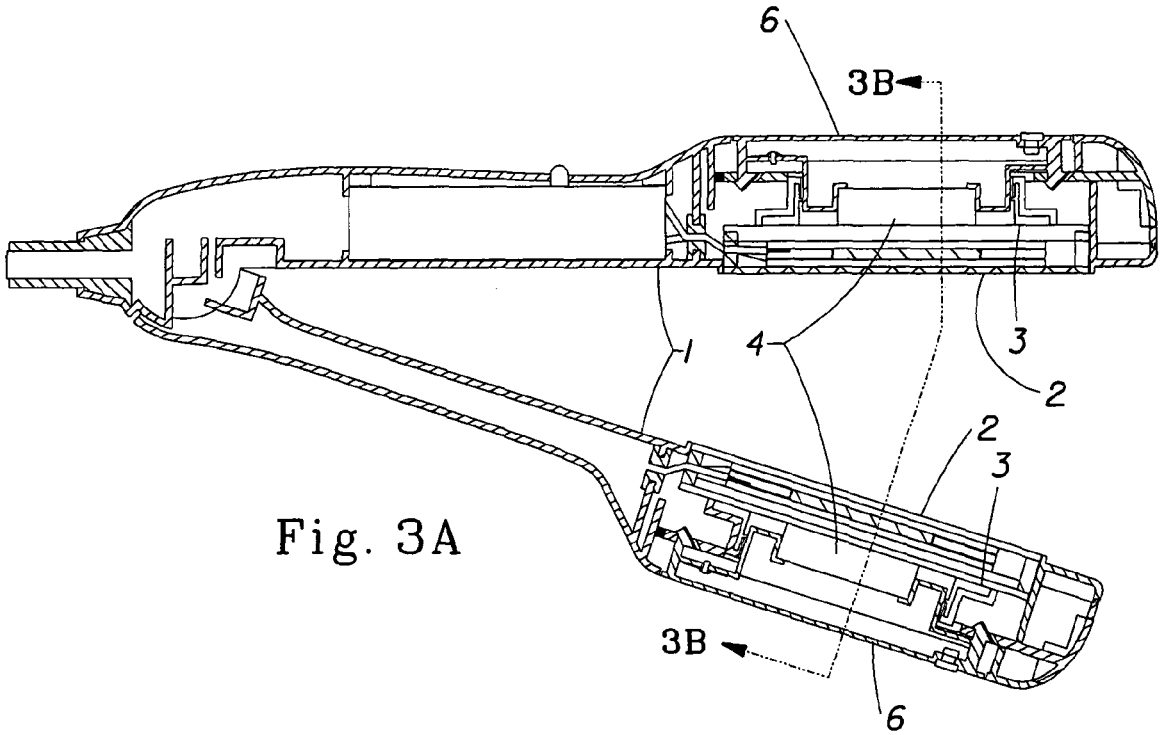
FIG. 3A is a longitudinal cross-sectional view of a hair styling device according to the present invention.
Figure 3B:
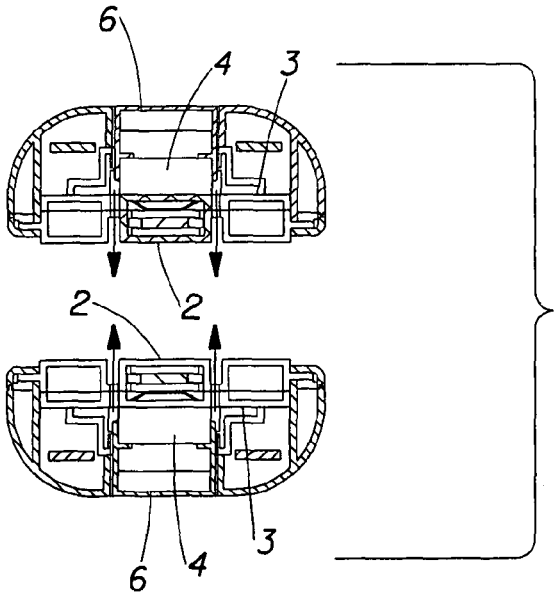
FIG. 3B is a transverse cross-sectional view, on an enlarged scale, taken along dotted line 3B of FIG. 3A.

FIGS. 3A and 3B depicts a non-limiting exemplary preferred embodiment of a hair styling device of the present invention comprising a gripping means (1) providing a heating means (2), a means of delivery (3), a means of transport (4), and a reservoir (6). As shown in FIG. 3A, the hair styling device of the present invention may be comprised of two hingedly attached, movably opposed arms each of said arms comprising a hair strand gripping means (1) for releasably gripping hair strands so that longitudinal tension can be applied thereto. The gripping means (1) forms a "V" shape. The gripping means (1) may be comprised of arms that can be hinged at one end and can be opened by the force of spring, as the hinged end is the fulcrum. The gripping means (1) compresses the hair when a compressive force is applied to the arms and longitudinal tension is applied to hair, by drawing, through the compressed gripping means (1), the hair. FIG. 3B is a transverse cross-sectional view, on an enlarged scale, taken along dotted line 3B of FIG. 3A. For illustrative purposes, everything beyond dotted line 3B has been omitted in FIG. 3B.

A heating means (2) supplies heat to hair that is compressed by the gripping means (1). The heating means (2) may be heated to a temperature range of 90° C. to about 210° C. A reservoir (6) stores a styling active making it readily available to a means of delivery (3) or a means of transport (4). The means of transport (4) carries a styling active from the reservoir (6) to the means of delivery (3). Therefore, the means of transport (4) allows the styling active in the reservoir (6) to be available to the means of delivery (3). The means of delivery (3) delivers the styling active to hair that is compressed by the gripping means (1). The means of delivery (3) changes the styling active to small droplets that are a more suitable form to be delivered to hair than what may result from delivering a styling active from current styling product forms (e.g. mousses, gels) or from larger droplets, as those resulting from conventional spray products. The styling active in such a state is attached more uniformly to hair as very thin layers and lowers the styling active levels required to deliver a benefit.

The means of delivery (3) controls the quantity of delivered styling active. The means of delivery (3) is in direct contact or close proximity with the means of transport (4).

Figure 4A:
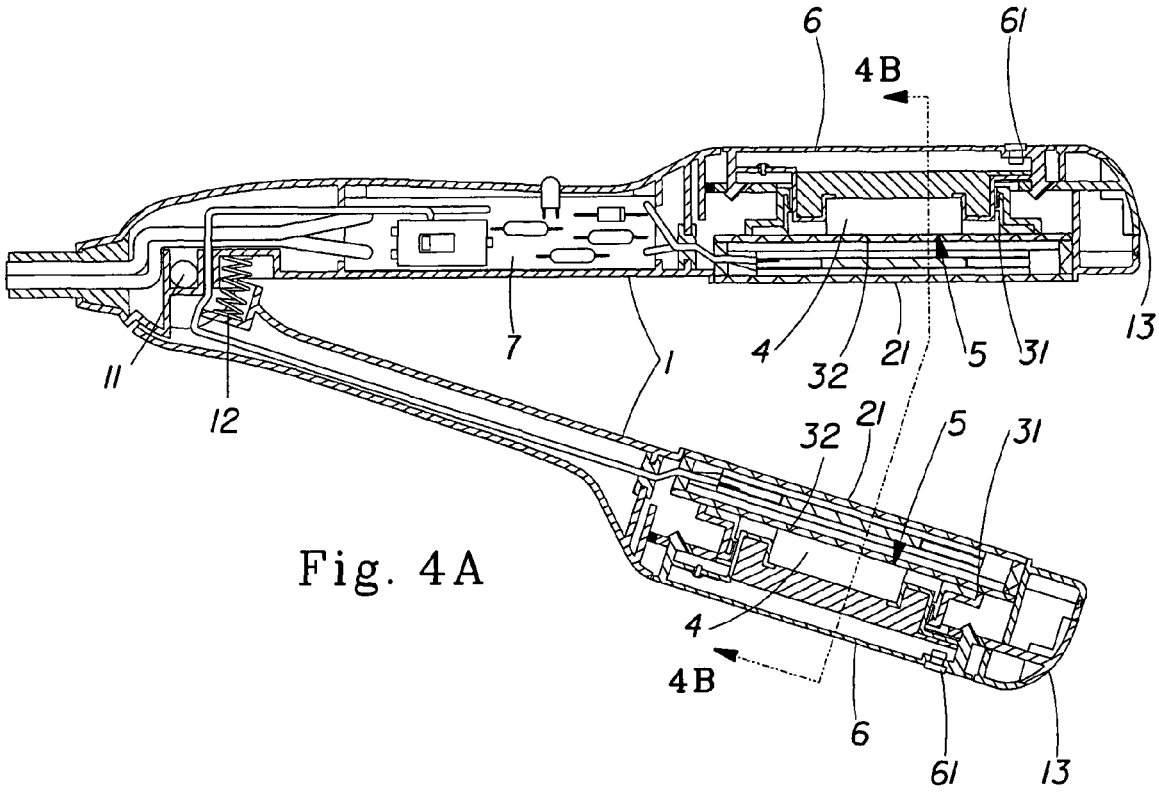
FIG. 4A is a longitudinal cross-sectional view of a hair styling device according to the present invention.
Figure 4B:
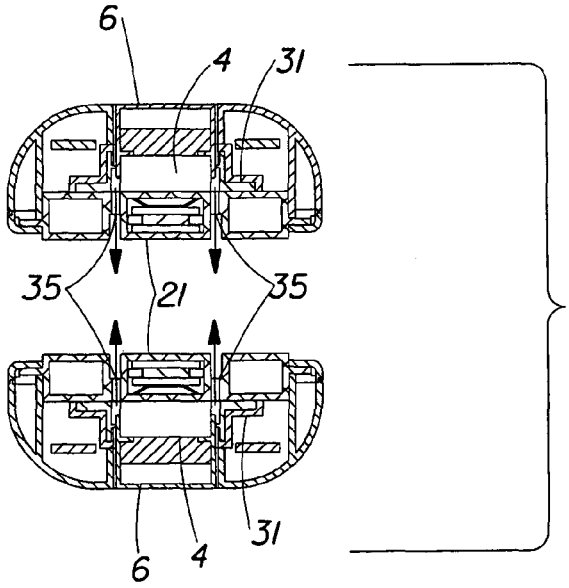
FIG. 4B is a transverse cross-sectional view, on an enlarged scale, taken along dotted line 4B of FIG. 4A.

FIGS. 4A and 4B depicts a non-limiting exemplary preferred embodiment of a hair styling device of the present invention comprising a gripping means (1) providing a heating plate (21), a heating chamber (31), a means of transport (4), a vaporizing plate (32), a reservoir (6) and electronics (7). As shown in FIG. 4A, the gripping means (1) is comprised of arms that can be hinged at one end and connected by a pin (11) and can be opened by the force of a spring (12) as hinged end is the fulcrum. FIG. 4B is a transverse cross-sectional view, on an enlarged scale, taken along 4B of FIG. 4A. For illustrative purposes, everything beyond dotted line 4B has been omitted in FIG. 4B. A means of delivery (3) (see FIG. 3A) is comprised of a heating chamber (31), a vaporizing plate (32) and a steam pass (35). A spring (12) functions to keep the two halves of the gripping means in an open configuration until pressure is applied. A pin (11) connects the two arms at the end of halves. If it is necessary to heat the styling active in order to change the styling active to small droplets, a means of vaporization (5) and heating chamber (31) are present as a part of the means of delivery (3) (FIG. 3A). The styling active also needs to be present with a volatile component in which it is soluble or dispersible. The means of vaporization (5) may be comprised of a vaporization plate (32) surrounded by a heating chamber (31) (FIG. 4A), in close proximity or contact to the means of transport (4), and applies heat to the styling active. The heating means (2) (FIG. 3A) is comprised of a heating plate (21), which supplies heat to hair that is compressed between the gripping means (1). The heating plate (21) is arranged inside of gripping means (1). The orientation of the heating plate (21) is arranged in parallel with the orientation of gripping means (1).

The length of the heating plate (21) in parallel with the orientation of gripping means (1) is able to cover the width of a partition of hair that is compressed by gripping means (1). The length of the heating plate (21) in parallel with the orientation of gripping means (1) is longer than the length of the heating plate (21) in perpendicular to the orientation of the gripping means (1). Each of the heating plates (21) in each arm comes together, when the two halves are closed. In the side of the gripping means in contact with hair, heating plates (21) have 2 rows of holes where the steam comes through the rows of holes.

A steam pass (35) comprises 2 rows of holes. The orientation of the rows of holes is arranged in parallel with the orientation of the gripping means (1), so it is effective to apply a styling active to a partition of hair. A reservoir (6) stores a styling active making it readily available to a means of transport (4) then to the vaporization plate (32) and then to the heating chamber (31) as a part of means of delivery (3) (FIG. 3A) Reservoir (6) is a refillable cartridge through a cap (61) of the reservoir (6). The reservoir (6) is attached to the gripping means (1) by hooking on a plate (13) and the reservoir (6) is detached from the gripping means (1) by pushing plate (13). In an embodiment of the present invention, as part of reservoir (6) or the entire reservoir (6) is a see-through cartridge allowing a view of the quantity of styling active in the reservoir (6). A reservoir (6) is arranged at opposite side of a heating plate (21) in the gripping means (1). The orientation of the reservoir (6) is arranged in parallel with the orientation of gripping means (1). The reservoir (6), means of transport (4) and vaporizing plate (32) contribute to decrease the temperature of the opposite side of the heating plate (21) in that the heat lost by the vaporization plate (32) reduces the temperature of the vaporizing plate (32) and heating plate (21).

In a further non-limiting exemplary embodiment of the present invention, a means of transport (4) comprises a felt which carries a styling active from a reservoir (6) to a means of vaporization (5). A felt is in fluid communication with a reservoir (6). A felt can be any porous material capable of wicking a composition. The vaporizing plate (32) is at the opposite side of a heating plate (21). The felt absorbs a styling active by the effect of capillary action. In the means of vaporization (5), a styling active is carried by a means of transport (4) and is vaporized by a vaporizing plate (32). The felt may have a contact area of about 10 to about 4000 $mm^2$ with the heating plate (21).

In order to provide the proper amount of vaporized styling active, it is necessary to extend the contact area that a vaporizing plate (32) contacts with a felt. If it is necessary to heat the styling active in order to change the styling active to small droplets, a means of vaporization (5) and heating chamber (31) are present as a part of the means of delivery (3). The styling active also needs to be present with a volatile component in which it is soluble or dispersible. An electronics (7) supplies electrical power to a heating plate (21) and vaporizing plate (32).

FIGS. 5A, 5B, 5C and 5D depicts a non-limiting exemplary embodiment of an element of the hair styling device of the present invention comprising a heater (20) which is comprised of a heater case (22), a heating element (23), a heater frame (24), an electrode plate (25), an insulation plate (26), a press plate (27) and a seal rubber (28). A heater case (22) is a jointed 3-tubes and is made of aluminum. In the center-tube of a heater case (22), there are the elements of the heater. Steam comes through a set of holes out of the part of joint ((Steam pass (35)). FIG. 5C is an exploded longitudinal cross-sectional view of a heater (20) in FIG. 5A. FIG. 5D is an exploded transverse cross-sectional view of heater (20) in FIG. 5B.

Hair that is pressed by a heating plate (21) is gotten wet in the steam pass (35) and is dried by the heating plate (21) that is outside of the steam pass (35). A pair of electrode plates (25) and insulation plates (26) are arranged symmetrically with respect to the heating element (23). A press plate (27) presses a heating element (23) and an electrode plate (25) and an insulation plate (26) toward the inside-wall of a heater case (22) for decreasing thermal resistance in a boundary area of each element. An electrode plate (25) supplies electrical power to a heating element (23). An insulation plate (26) insulates electrically an electrode plate (25) and a heating element (23) from the heater case (22). A heater frame (24) sets a heating element (23) at the center of a heater (20). A heating element (23) heats a heating plate (21) and vaporizing plate (32) and steam pass (35) and other elements of the heater (20).

FIGS. 6A, 6B, 6C and 6D depicts a non-limiting exemplary embodiment of an element of the hair styling device of the present invention comprising a means of delivery (3) which comprises a heating chamber (31) (FIG. 4A), a vaporizing plate (32) and a steam pass (35) (FIG. 4B) and further depicts a heater (20). Likewise, the heating chamber (31) is comprised of a chamber seal rubber (33) and a chamber case (34). The chamber seal rubber (33) closes the space that is between the vaporizing plate (32) and the means of transport (4) (see FIG. 4A). The chamber case (34) reinforces the chamber seal rubber (33). FIG. 6C is an exploded longitudinal cross-sectional view of a means of delivery (3) in FIG. 6A. FIG. 6D is an exploded transverse cross-sectional view of a means of delivery (3) in FIG. 6B.

Figure 7A:
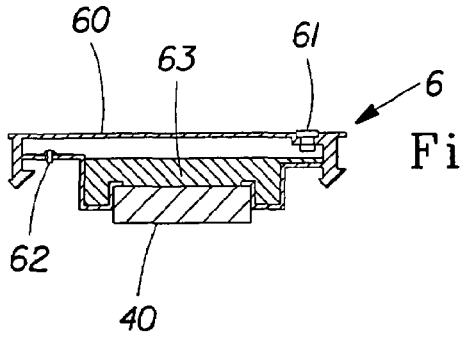
FIG. 7A is a longitudinal cross-sectional view of a means of transport comprised of a felt and a reservoir according to the present invention.
Figure 7B:
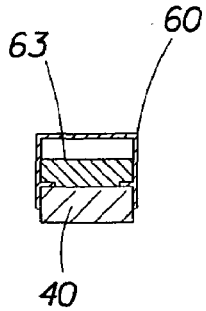
FIG. 7B is a transverse cross-sectional view of a means of transport comprised of a felt and a reservoir according to the present invention.
Figure 7C:
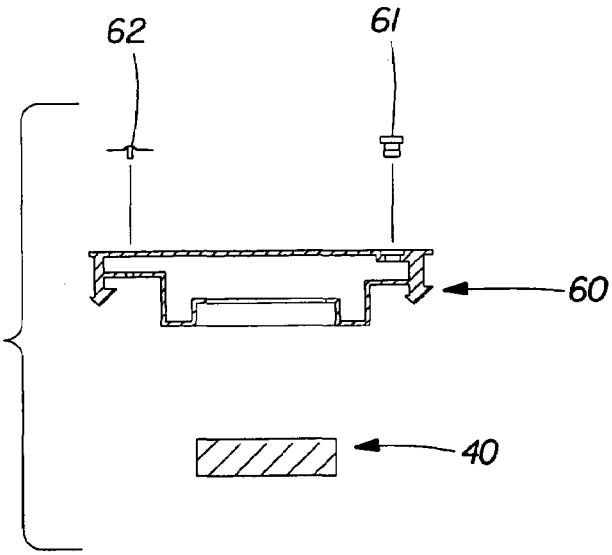
FIG. 7C is an exploded longitudinal cross-sectional view of a means of transport comprised of a felt and a reservoir according to the present invention.
Figure 7D:
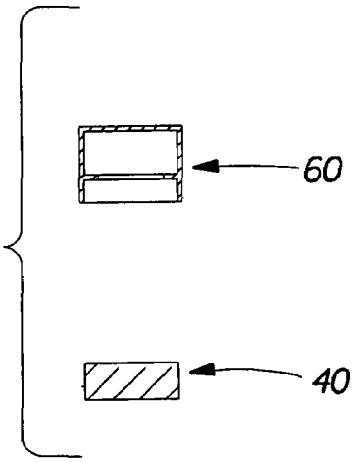
FIG. 7D is an exploded transverse cross-sectional view of a means of transport comprised of a felt and a reservoir according to the present invention.

FIGS. 7A, 7B, 7C, and 7D depicts a non-limiting exemplary embodiment of an element of a hair styling device of the present invention comprising a reservoir (6). The reservoir (6) is comprised of a reservoir case (60), a cap (61) and a pressure valve (62). FIG. 7C is an exploded longitudinal cross-sectional view of a means of transport and a reservoir (6) as shown in FIG. 7A. FIG. 7D is an exploded transverse cross-sectional view of a means of transport and a reservoir (6) as shown in FIG. 7B. The means of transport is comprised of a felt (40) which covers the open areas of the reservoir case (60). The reservoir (6) is a refillable cartridge through the cap (61) which acts to close the opening in the reservoir (6) and provide opening to add a styling active (63). A pressure valve (62) is made of rubber and has the shape similar to an umbrella. As the styling active contained on the felt (40) is vaporized by the vaporizing plate (32) (FIG. 4A), the felt (40) absorbs a styling active present in the reservoir (6) and results in the inside pressure of reservoir (6) being decreased. The felt (40) absorbs the styling active (63), as long as the felt (40) touches the styling active (63) in the reservoir (6). A pressure valve (62) is opened only when the inside pressure of the reservoir (6) is smaller than the pressure outside. The pressure valve (62) controls the quantity of styling active that is made available to the vaporizing plate (32) (FIG. 4A) and therefore vaporized.

Figure 8A:
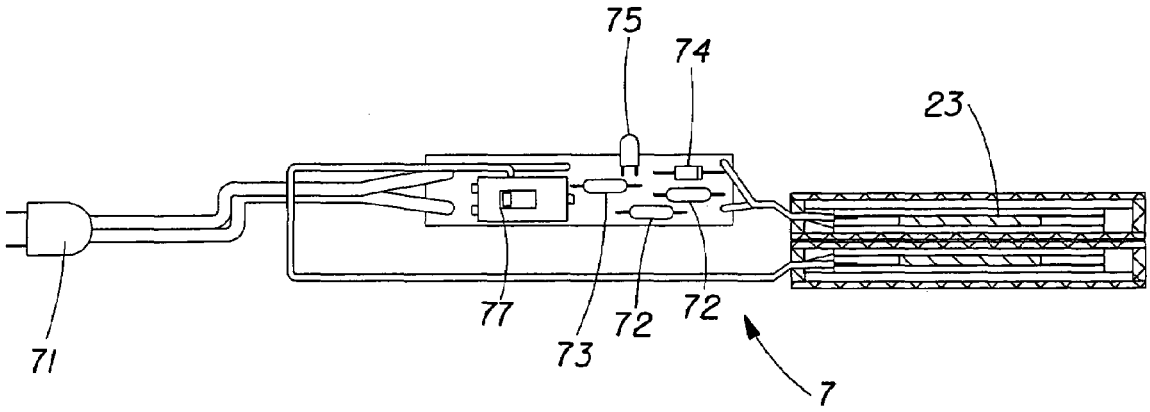
FIG. 8A is a longitudinal cross-sectional view of the electronics according to the present invention.
Figure 8B:
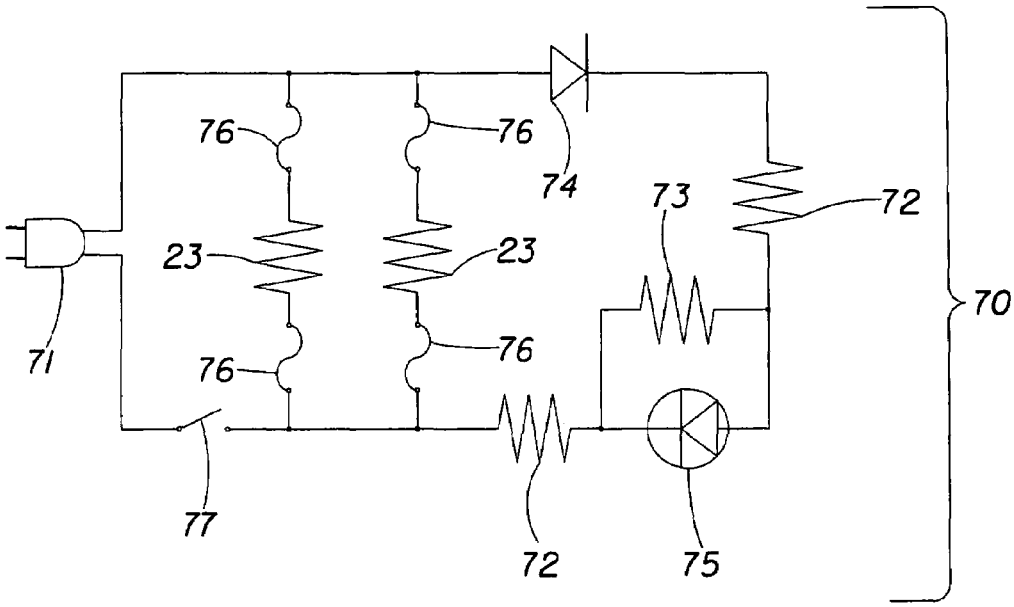
FIG. 8B is a schematic diagram of electrical wiring arranged to conduct current to heat generating resistance wire according to the present invention.

FIGS. 8A and 8B depicts a non-limiting exemplary embodiment of an element of a hair styling device of the present invention comprising electronics (7) which supplies electrical power to a heating element (23). The electronics (7) is comprised of a plug (71), resistors (72 and 73), a diode (74), an LED (75), a fuse (76) and a switch (77). According to switch on (Switch (77), electrical power is supplied to the heating element (23). The heating element (23) is a Positive Thermal Coefficient (PTC heater). The heating element (23) may be self-adjusting for the temperature. FIG. 8B depicts a schematic diagram (70) of electric wiring arranged to conduct current to a heat generating resistance wire.

Figure 9A:
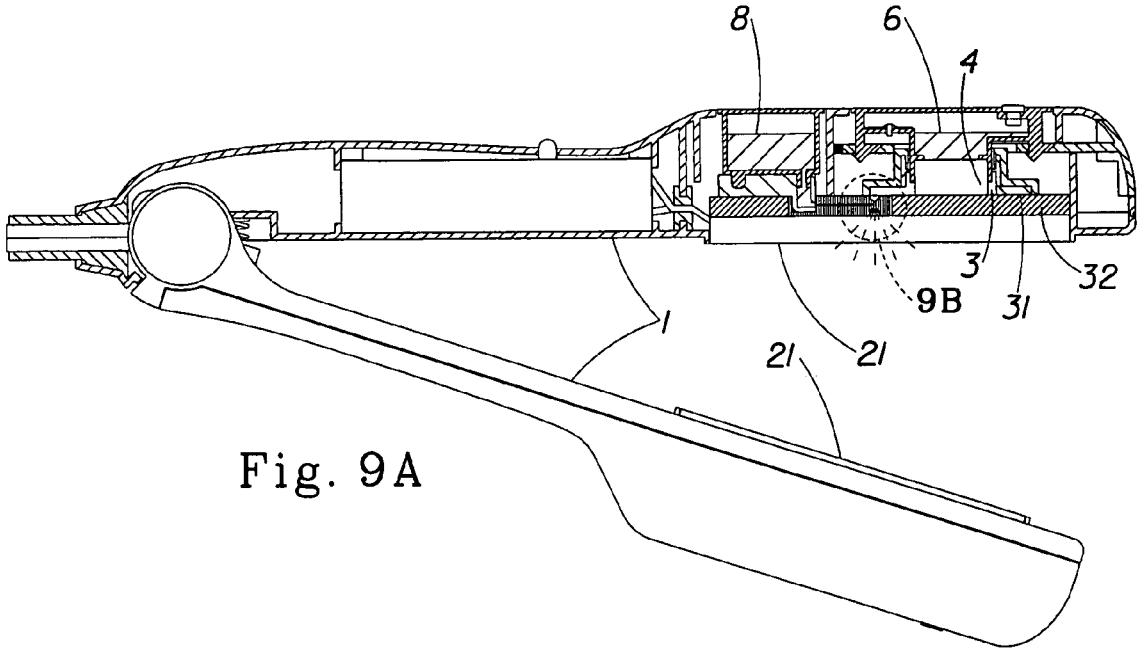
FIG. 9A is a longitudinal cross-sectional view of an embodiment of the present invention wherein a hair styling device according to the present invention comprises a gripping means, the gripping means comprising a second reservoir and alternative means of delivery.
Figure 9B:
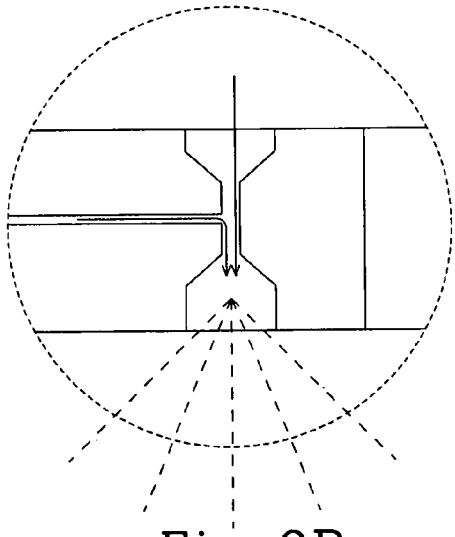
FIG. 9B is a cross-sectional view of an embodiment of the present invention of an alternative means of delivery.

FIG. 9A depicts a non-limiting exemplary embodiment of a hair styling device of the present invention comprising a means of delivery (3), a pin (11), a spring (12), and a second reservoir (8) per side of gripping means (1), having a heating plate (21), and which is separated from reservoir (6). Styling active in the second reservoir (8) may not be the same styling active as in reservoir (6). The steam of the styling active in reservoir (6) pulls the styling active in the second reservoir (8). Water must be present in at least one of the reservoirs. In the means of delivery (3): a) reservoir (6) uses a means of transport (4), a vaporization plate (32) and a heating chamber (31) to create a mist from the styling active; b) a second reservoir (8) provides a means to atomize the reservoir contents of second reservoir (8). The two streams created from each of the reservoirs are thus combined as they come out of the hair styling device. FIG. 9B depicts a non-limiting exemplary embodiment of a hair styling device of the present invention which is a cross-sectional view of an alternative means of delivery (3).

Figure 10A:
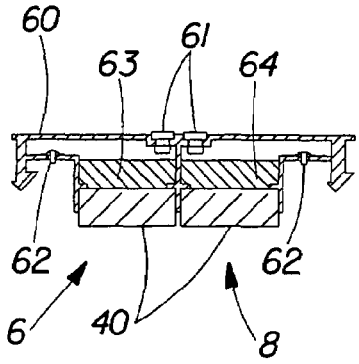
FIG. 10A is a longitudinal cross-sectional view of an embodiment of the present invention wherein a reservoir is fillable from different sites on the reservoir having two chambers and two compositions.
Figure 10B:
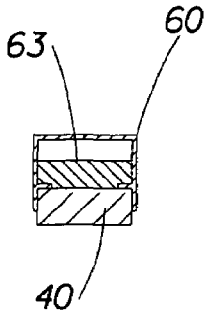
FIG. 10B is a transverse cross-sectional view of an embodiment of the present invention wherein a reservoir is fillable from different sites on a reservoir having two chambers and two compositions.
Figure 10C:
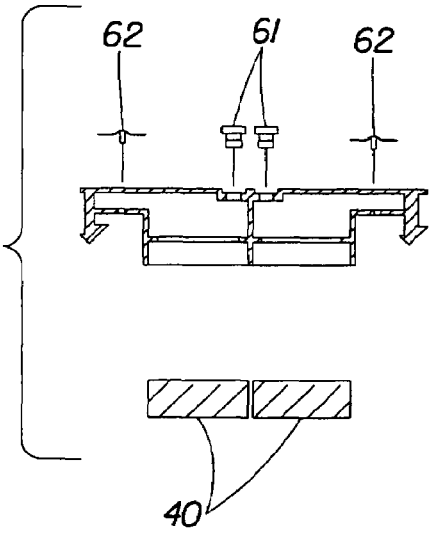
FIG. 10C is an exploded longitudinal cross-sectional view of an embodiment of the present invention wherein a reservoir is fillable from different sites on the reservoir having two chambers and two compositions.
Figure 10D:
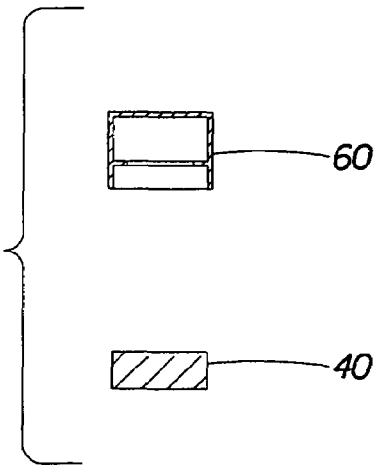
FIG. 10D is an exploded transverse cross-sectional view of an embodiment of the present invention wherein a reservoir is fillable from different sites on the reservoir having two chambers and two compositions.

FIGS. 10A, 10B, 10C and 10D depicts a non-limiting exemplary embodiment of an element of a hair styling device of the present invention comprising a reservoir (6) which is separated into two chambers. A second reservoir (8) is separated from a reservoir (6). A reservoir case (60) comprises a reservoir (6) and a second reservoir (8). The styling active (63) in the reservoir is not same as styling active (64) in the second reservoir (8). Reservoir (6) and the second reservoir (8) each have a cap (61), a pressure valve (62), and are in fluid communication with a felt (40), respectively. Water must be present in at least one of the reservoirs. FIG. 10C is an exploded longitudinal cross-sectional view of an embodiment of the present invention as shown in FIG. 10A, wherein a reservoir (6) and a reservoir (8) are fillable. FIG. 10D is an exploded transverse cross-sectional view of an embodiment of the present invention as shown in FIG. 10B.

FIGS. 11A, 11B, 11C and 11D depicts a non-limiting exemplary embodiment of an element of a hair styling device of the present invention comprising a reservoir (6) which is non-refillable. The reservoir (6) comprises a reservoir case (60), a pressure valve (62), a styling active (63) and further depicting a felt (40). The reservoir (6) is prefilled with a styling active and inserted into the hair styling device. When the reservoir (6) is empty, the reservoir (6) can be removed and replaced with another pre-filled reservoir (6), or as termed, a disposable cartridge or non-refillable cartridge. FIG. 11C depicts an exploded longitudinal cross-sectional view of a non-refillable cartridge as shown in FIG. 11A. FIG. 11D depicts an exploded transverse cross-sectional view of a non-refillable cartridge as shown in FIG. 11B.

Figure 12A:
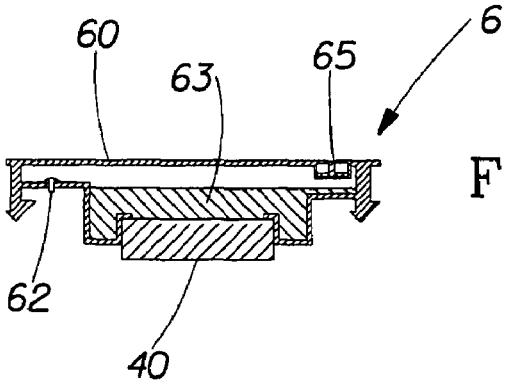
FIG. 12A is a longitudinal cross-sectional view of an embodiment of the present invention comprising a re-fillable reservoir.
Figure 12B:
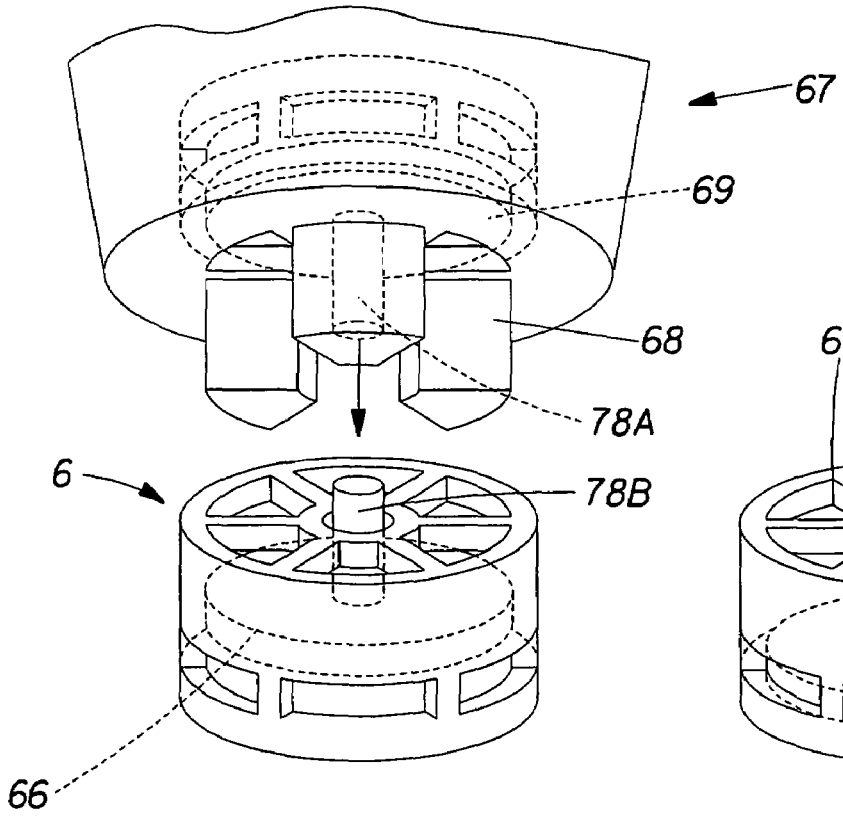
FIG. 12B is a perspective view of an embodiment of the present invention comprising a re-fillable reservoir when not linked.
Figure 12C:
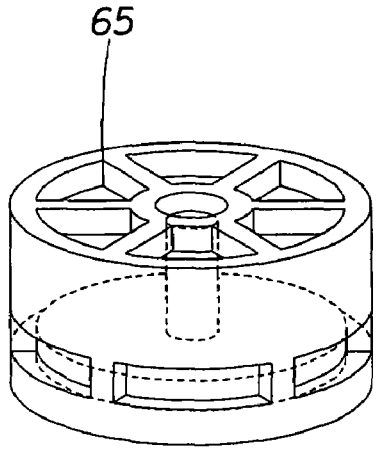
FIG. 12C is a perspective view of an embodiment of the present invention comprising a re-fillable reservoir when linked.

FIGS. 12A, 12B and 12C depicts a non-limiting exemplary embodiment of an element of a hair styling device of the present invention comprising a reservoir (6) which is capable of being refilled. FIG. 12A depicts a reservoir (6) comprising a reservoir case (60), a pressure valve (62), a styling active (63), a first exclusive joint (65) and further depicting a felt (40). The reservoir (6) comprises a first exclusive joint (65) that only fits to a second exclusive joint (68) on a styling active bottle (67), as shown in FIG. 12B. The reservoir (6) can be refilled with a styling active only from a bottle that has a second exclusive joint (68). As shown in FIG. 12B, in a state of non-link, a first seal plate (66) prevents the styling active from leaking out of the reservoir (6). In a similar manner, a second seal plate (69) prevents a styling active from leaking out of a styling active bottle (67). A first seal plate (66) and a second seal plate (69) are the shape of a disk and each have a bottle stick (78A) and a reservoir stick (78B) that is in center of first seal plate (66) and a second seal plate (69) and extends outwardly. In the state of non-link, a first seal plate (66) and a second seal plate (69) may be pushed out by the force of springs and close respectively the gateways of styling active in a reservoir (6) and a styling active bottle (67).

In a state of link, as shown in FIG. 12C, a second exclusive joint (68) of a styling active bottle (67) pushes a first seal plate (66) of a reservoir (6) and the stick (78B) of a first seal plate (66) pushes the stick (78A) of a second seal plate (69). In this manner, a first seal plate (66) and a second seal plate (69) open respectively the gateways of styling active in a reservoir (6) and a styling active bottle (67). A second exclusive joint (68) is comprised of three parts the shape of circle divided into six equal. A second exclusive joint (68) can be jointed to a first exclusive joint (65), even if the second exclusive joint (68) would be turned around at an angle of 60°.

In a further embodiment of the present invention, the one or more of the reservoir (6) resides in the arms of the gripping means (1). In yet a further embodiment of the present invention, the reservoir (6) comprises a removable pre-filled cartridge. In yet a further embodiment of the present invention, the reservoir (6) is refillable through a first exclusive joint (65).

Figure 13A:
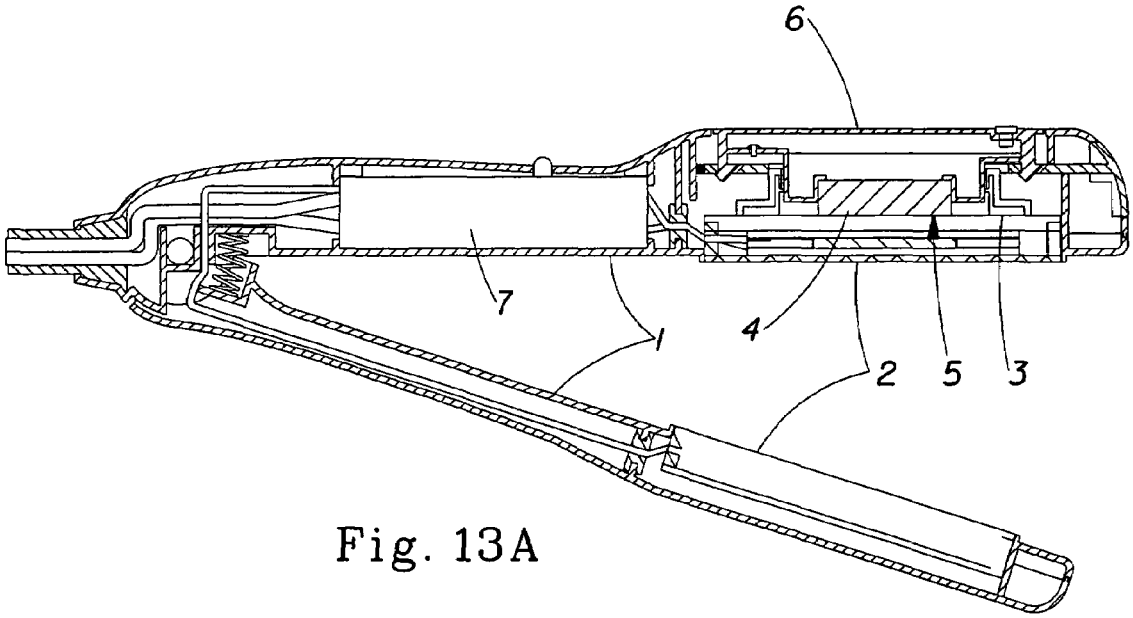
FIG. 13A is a longitudinal cross-sectional view of an embodiment of a hair styling device according to the present invention wherein a gripping means wherein delivery of juice is from one side of a gripping means.
Figure 13B:
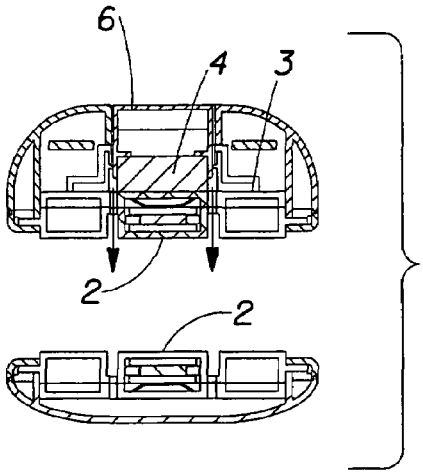
FIG. 13B is a transverse cross-sectional view of an embodiment of a hair styling device according to the present invention comprising a gripping means wherein delivery of juice is from one side of a gripping means.

FIGS. 13A and 13B depict a non-limiting exemplary embodiment of a hair styling device of the present invention comprising one arm of a gripping means (1) comprised of a heating means (2), a means of delivery (3), a means of transport (4), a means of vaporization (5), a reservoir (6), a pin (11), a spring (12) and electronics (7). The opposing arm is comprised of a heating means (2). This embodiment of the hair styling device will provide a styling active coming from one side of gripping means (1).

Figure 14A:
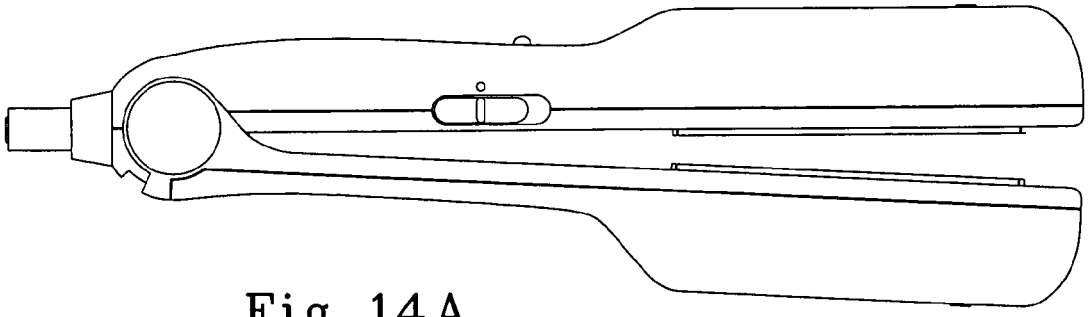
FIG. 14A is a perspective view of an embodiment of the present invention comprising a gripping means attached at one end of two arms.
Figure 14B:
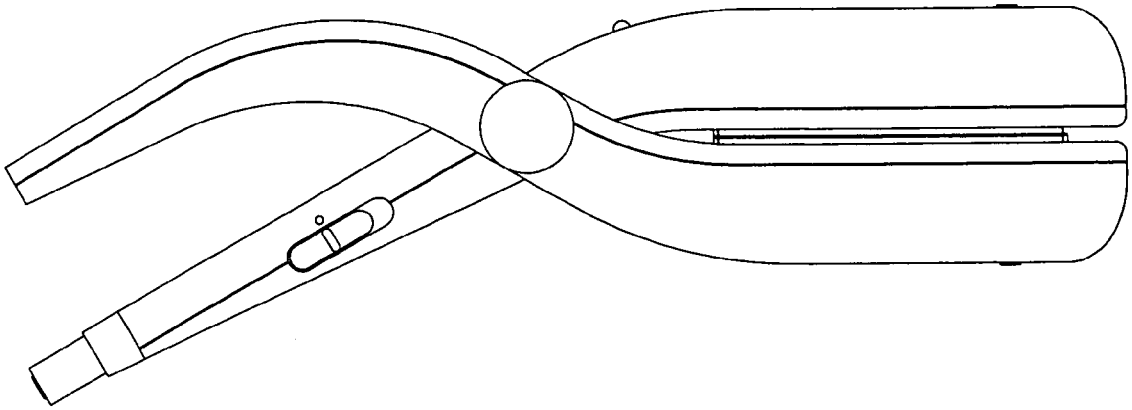
FIG. 14B is a perspective view of an embodiment of the present invention comprising a gripping means attached in the middle of two arms.

FIG. 14A depicts a non-limiting exemplary embodiment of a hair styling device of the present invention comprising a gripping means (1) which is be hinged at one end, and further comprising a pin (11) and a switch (77). FIG. 14B depicts a non-limiting exemplary embodiment of a hair styling device of the present invention comprising a gripping means (1) comprising a scissors type arm of a gripping device which results in an X-shaped arm. The gripping means (1) is comprised of two arms that are hinged in the middle, and comprised of a pin (11) and a switch (77).

Figure 15A:
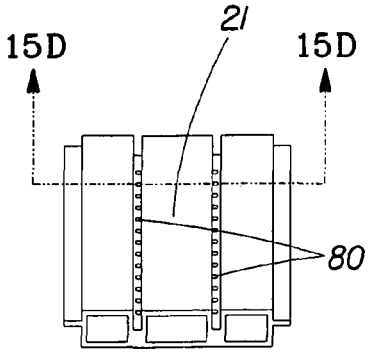
FIG. 15A is a perspective view of an embodiment of the present invention comprising a heating plate and multiple rows of holes.
Figure 15B:
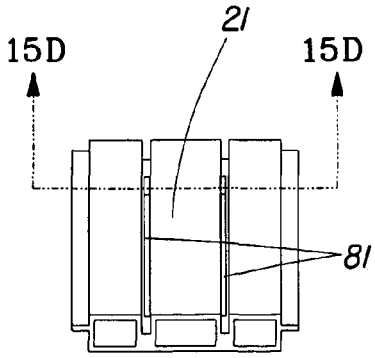
FIG. 15B is a perspective view of an embodiment of the present invention comprising a heating plate and multiple rows of groove
Figure 15C:
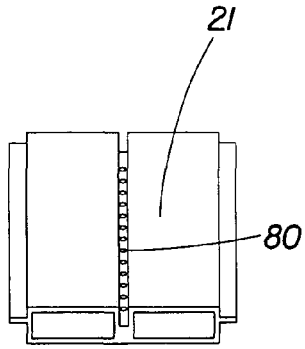
FIG. 15C is a perspective view of an embodiment of the present invention comprising heating plate and a single row of holes.
Figure 15D:
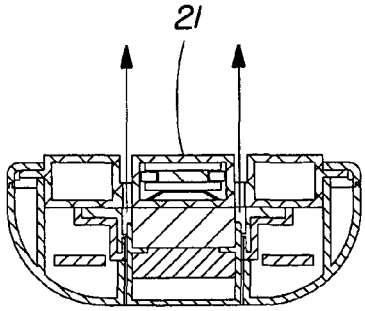
FIG. 15D is a transverse cross-sectional view, on an enlarged scale, taken along either dotted line 15D of FIG. 15A or FIG. 15B.

FIG. 15A depicts a non-limiting exemplary embodiment of an element of a hair styling device of the present invention comprising a heating plate (21), which is contact with the hair, comprising two or more rows of holes (80) where the steam and styling active exit and contact the hair being straightened. In an embodiment of the present invention, a hole (80) may have a diameter in a range of about 0.5 nm to about 2.5 mm. FIG. 15B depicts a non-limiting exemplary embodiment of an element of a hair styling device of the present invention comprising a heating plate (21) which is comprised of two or more rows of groove (81). FIG. 15C depicts a non-limiting exemplary embodiment of an element of a hair styling device of the present invention comprising a heating plate (21) which is comprised of a row of holes (80) which are oriented and arranged in parallel with the orientation of a gripping means (1), in order to effectively apply styling active to a partition of hair. FIG. 15D depicts a non-limiting exemplary embodiment of an element of a hair styling device of the present invention depicting a transverse cross-sectional view, on an enlarged scale, taken along either dotted line 15D of FIG. 15A or FIG. 15B. In a further embodiment of the present invention, a reservoir (6) (FIG. 4A) is in fluid communication with the hair strands through the rows of holes (80) or groves (81) located in one or more of the gripping means (1).

Figure 16A:
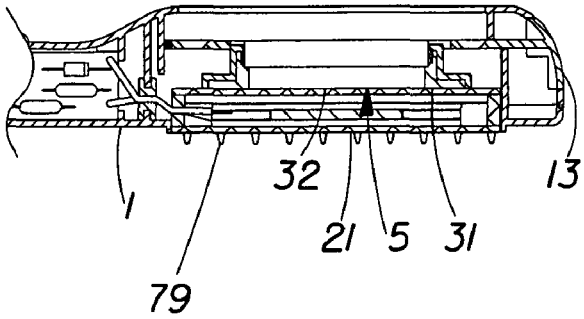
FIG. 16A is a longitudinal cross-sectional view, taken along dotted line 16A of FIG. 16B, of an embodiment of the present invention showing a hair styling device comprising a gripping means wherein the reservoir has been removed.
Figure 16B:
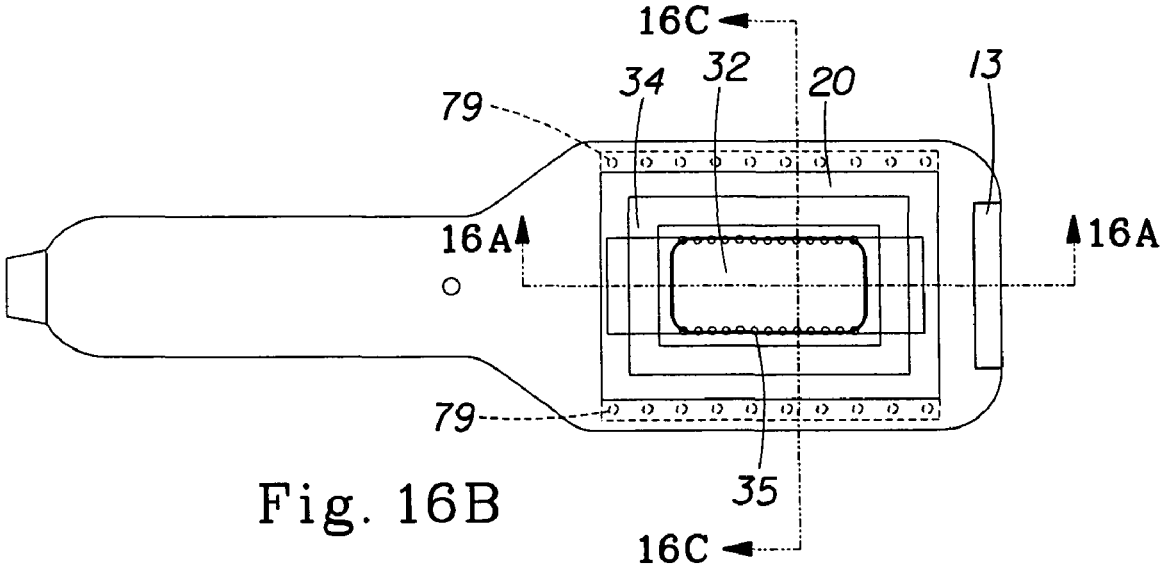
FIG. 16B is a top view of an embodiment of the present invention showing a hair styling device comprising a gripping means wherein the reservoir has been removed.
Figure 16C:
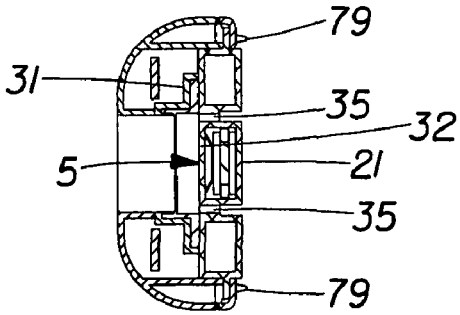
FIG. 16C is a transverse cross-sectional view, taken along dotted line 16C of FIG. 16B.

FIGS. 16A, 16B and 16C depict a non-limiting exemplary embodiment of a hair styling device of the present invention providing a top view of one side of the gripping means (1), with the reservoir (6) removed, as shown in FIG. 16B. FIG. 16A is a longitudinal cross-sectional view, taken along dotted line 16A of FIG. 16B, of an embodiment of the present invention showing a gripping means with the reservoir removed. The gripping means comprises a means of vaporization (5), plate (13), heating plate (21), heating chamber (31), vaporizing plate (32), chamber case (34), steam pass (35) and heater (20). As a further embodiment of the hair styling device of the present invention, the gripping means (1) may further contain a plurality of teeth (79) located on the each side of the heater (20) and protruding outwardly from. Such plurality of teeth (79) may provide assistance in partitioning hair and providing further alignment of hair between the gripping means (1). FIG. 16C depicts a transverse cross-sectional view, taken along dotted line 16C of FIG. 16B.

Styling Active

The components, including those which may optionally be added, of the actives and compositions used in the present invention, as well as methods for preparation, and methods for use, are described in detail below.

The styling actives of the present invention may be any known or otherwise effective hair styling agents that are liquids or semisolids under ambient conditions and that can remain a liquid or semisolid after the composition has been applied and allowed to dry on dry hair. The styling actives of the present invention do not readily penetrate into the hair and can remain on the hair fibers to provide the improved hair styling benefits. Such styling actives can provide for a fluid film to be left on the hair which can be characterized as a reformable weld that allows the hair fibers to be separated by forces such as wind, and then re-adhere using styling techniques such as combing, brushing, or running your fingers through the hair.

The styling active component of the present invention may include any of the following materials mentioned and described in below, either alone or in combination.

I. Polyalkylene Glycols

In the present invention the preferred styling agents suitable for use include those polyalkylene glycols, which conform to the formula:

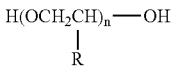

wherein R is selected from the group consisting of H, $C_1$–$C_4$ alkyl, such as methyl, and mixtures thereof. When R is H, these materials are polymers of ethylene oxide, which are also known as polyethylene oxides, polyoxyethylenes, and polyethylene glycols. When R is methyl, these materials are polymers of propylene oxide, which are also known as polypropylene oxides, polyoxypropylenes, and polypropylene glycols. When R is methyl, it is also understood that various positional isomers of the resulting polymers can exist.

Preferred are those water-soluble polyalkylene glycols which have a number average molecular weight of from about 190 to about 1500, preferably from about 300 to about 1200, more preferably from about 400 to about 1000; and from about 5 to about 35, preferably from about 5 to about 30, more preferably from about 5 to about 20, repeating alkylene oxide radicals wherein each of the repeating alkylene oxide radicals has from 2 to 6 carbon atoms.

Specific examples of the most preferred polyalkylene glycols include, but are not limited to, PPG-4 wherein R equals methyl and n has an average value of about 4; PEG-8 wherein R equals H and n has an average value of about 8 (PEG-8 is also known as Carbowax 400, which is available from Union Carbide); PEG-12 wherein R equals H and n has an average value of about 12 (PEG-12 is also known as Carbowax 600, which is available from Union Carbide); and PEG-20 wherein R equals H and n h Carbowax 900, which is available from Union Carbide).

II. Polyethylene/Polypropylene Glycol Copolymers

Styling agents suitable for use herein include those polyoxyethylene/polyoxypropylene block copolymers such as Poloxamer 123 (Pluronic 1-43) by BASF; Poloxamer 184 (Pluronic L-64) by BASF; Poloxamer 331 (Pluronic L-101) by BASF; Polyoxypropylene/polyoxyethylene/polyoxypropylene copolymers such as Pluronic 25R4, Pluronic 25R1 by BASF, Polyoxyethelene/polyoxypropyleneblock polymers of ethylene diamine: such as Poloxamine 504 (Tetronic 702) by BASF; Poloxamine 1101 (Tetronic 1101) by BASF; Tetronic 90R4 by BASF and combinations thereof.

III. Alkoxy Polyethylene Glycol

Other styling agents suitable for use herein include Methoxy PEG 10 (Carbowax MPEG 550) by Union Carbide; alkoxy (including methoxy, ethoxy, propoxy, butoxy, and pentoxy) polypropylene glycol; alkoxy (including methoxy, ethoxy, propoxy, butoxy, and pentoxy) polyethylene/polypropylene glycol copolymers and combinations thereof.

IV. Polyalkylene Glyceryl Ether and its Derivatives (Also Known as Polyoxyalkylene Ethers of Glycerin)

Especially preferred are the polyoxyethylene glyceryl ethers: Glycereth-7 (Liponic EG-7 from Lipo), Glycereth-12 (Unipeg-ETG-12 from UPI), and Glycereth-20 (Carbowax TPEG 990 from Union Carbide) and combinations thereof.

V. Polyalkylene Glycol Esters of Fatty Acid

Other styling agents suitable for use herein include polyalkylene glycol esters of fatty acids, including monoesters and diesters. Such styling include PEG-10 Oleate (Ethofat 0/20) by Akzo; PEG-8 Dioleate (Pegosperse 400 DO) by Lonza; PEG-12 Laurate (Lipogel 6-L) by Lipo; PEG-8 Cocoate (Waglinol 488) by Industrial Quimica; PEG-8 Dicocoate (ROL DL40) by Fabriquimica; PEG-8 Diisostearate (PEG 400 Diisostearate) by Scher; PEG-12 Dilaurate (Kessco PEG600 Dilaurate) by Stepan and combinations thereof.

VI. Polyalkylene Glycol Ether of Aliphatic Alcohols

Other styling agents suitable for use herein include Oleth-5 (Volpo-5) by Croda; Oleth-10 (Volpo-10) by Croda; Laureth-7 (Rhodasurf L-7-90) by Rhone-Poulenc; Laureth-12 (Ethosperse LA-12) by Lonza and combinations thereof.

VII. Polyalkylene Glyceryl Ester of Fatty Acids

Still other styling agents suitable for use herein includes polyalkylene glyceryl ester of fatty acids (including monoesters, diesters, and trimesters) Glycereth-5 Lactate (Pelemol G45L) by Phoenix; Glycereth-7 Triacetate (Dermol GL-7A) by Alzo; PEG-7 Glyceryl Cocoate (Tegosoft GC) by Goldsmith; PEG-12 Glyceryl Laurate (Unibiovit B-332 WS); PEG-5 Glyceryl Triisostearate (Emalex GWIS-305) by Nihon and combinations thereof.

VIII. Glyceryl Alkylate

Still other styling agents suitable for use herein includes glyceryl alkylates (ester of glycerin and fatty acid, glyceride including monoester, diester, and triesters) Glyceryl Adipate (Trioxene A) by Vevy; Glyceryl Dilaurate (Lexemul GDL) by Inolex; Glyceryl Laurate (Protachem MLD) by Protameen; Lauric/Palmitic/Oleic Tryglyceride and combinations thereof.

IX. Glycol Alkylate

Still other styling agents suitable for use herein includes glycol alkylate (esters of alkylene glycol and fatty acid including monoesters, diesters). Prefered are esters of ethylene glycol and fatty acids, Glycol Dilaurate (Kemester EGDL) by Witco; Glycol Oleate; Lauryl Glycol (Mexanyl GU) by Chimex and combinations thereof.

X. Polyglycerol (Ether of Glycerol with Itself; Polyglycerins)

Still other styling agents suitable for use herein includes hexaglycerol; decaglycerol; triglycerin and mixtures thereof, and/or their derivatives, and combinations thereof.

XI. Polyglycerol Ester

Still other styling agents suitable for use herein includes polyglycerol esters ( including monoesters, diesters, and triesters), decaglycerol monostearate; decaglycerol hexaoleate; triglycerol monolinoleate; triglycerol trilinoleate and combinations thereof.

XII. Soluble/Dispersible Nonvolatile Silicone Copolyols

Suitable for use herein includes soluble/dispersible nonvolatile silicone copolyols wherein the level of ethylene and/or propylene oxide is sufficient to allow solubility in the composition.

A. Suitable examples include dimethicone copolyols, e.g. polyether siloxane-modified polymers, such as polyethylene oxide modified polydimethylsiloxane such as PEG-8 Dimethicone (Ultrasil Copolyol -7) by Noveon and combinations thereof.

B. Dimethicone copolyol esters such as Dimethicone PEG-7 Cocoate (Ultrasil SW-12) by Noveon Included in the present invention as additional useful styling active materials can be polyalkylene glyceryl ether of aliphatic alcohols, glyceryl alkyl ether including ether of glycerin and aliphatic alcohol and mixtures thereof.

All of the fatty acids as described herein for can be saturated or unsaturated; linear, branched, or cyclic. Likewise, all of the Aliphatic alcohols as described herein can be saturated or unsaturated; linear, branched or cyclic.

The styling active of the present invention may comprise from about 0.1% to about 90%, preferably from about 1% to about 30%, more preferably from about 2% to about 15%, by weight of the composition. When vaporization is used, a volatile carrier is required in which the styling active will be soluble or dispersible. The carrier is needed with the heat from the vaporizing plate (32) to create small droplets that will carry the styling active to hair. A preferred carrier of the present invention is water. If water is a volatile carrier, one reservoir may be enough per side. If water isn't the preferred carrier used, 2 reservoirs per side may be needed in which one reservoir will comprise a styling active and another reservoir will comprise water (steam).

The water that may be delivered by the present invention may comprise from about 0.01–2 grams per minute per side of the styling device which would be equal to about 0.02 to about 4 grams per minute for the total of 2 sides of the styling device delivering, preferably from about 0.1 to about 1 gram per minute per side which would be equal to from about 0.2 to about 2 grams per minute for the total of 2 sides of the styling device delivering, more preferably from about 0.15 to about 0.4 grams per minute per side, which would be equal to from about 0.3 to about 0.8 grams per minute for the total of 2 sides of the styling device delivering.

The droplet size of the styling active for the present invention is measured according to a Dv(90) value wherein 90% of the volume is formed by droplets of a designated micron size or less. For the present invention, the Dv(90) may be less than about 30 microns, preferably less than about 20 microns, and more preferably less than about 12 microns. Droplet size values have been measured according to an Insitec Measurement System.

The delivery rate of styling composition, wherein in one embodiment the styling composition is comprised of a styling active in combination with a carrier, according to the present invention may comprise from about 0.05 to about 2 grams per minute per side of the styling active which would be equal to about 0.1 to about 4 grams per minute for the total of 2 sides of the styling device delivering, preferably from about 0.1 to about 1 grams per minute per side of the styling active which would be equal to about 0.2 to about 2 grams per minute for the total of 2 sides of the styling device delivering, more preferably from about 0.15 to about 0.4 grams per minute per side of the styling active which would be equal to about 0.3 to about 0.8 grams per minute for the total of 2 sides of the styling device delivering.

Volatile Carriers

In the present invention, a liquid carrier may help to solubilize or disperse the styling actives described hereinbefore. The liquid carrier can comprise one or more liquid carriers provided that the selected styling active is sufficiently miscible/dispersible in the selected liquid carrier.

The total concentration of the liquid carrier in the composition will vary with the type of liquid carrier selected, the type of styling active used in combination with the liquid carrier, and the solubility of the selected styling active in the selected liquid carrier, and so forth. Preferred total concentration of the liquid carrier ranges from about 10% to about 99.9%, preferably from about 70% to about 99%, more preferably from about 85% to about 98%, by weight of the composition.

Suitable liquid carriers for use in the compositions of the present invention are volatile liquid carrier materials. In this context, the term "volatile" refers to materials which have a boiling point of less than about 260° C., preferably from about 50° C. to about 260° C., more preferably from about 60° C. to about 150° C. (at about one atmosphere of pressure).

Nonlimiting examples of volatile liquid carriers include water, organic solvents such as $C_1$–$C_6$ alkanols, and combinations thereof. Specific examples of suitable $C_1$–$C_6$ alkanols include, but are not limited to, ethanol, n-propanol, isopropanol, n-butanol, amyl alcohol, and mixtures thereof. Preferred $C_1$–$C_6$ alkanols include $C_2$–$C_4$ monohydric alcohols such as ethanol, isopropanol, and mixtures thereof. Water is the preferred volatile liquid carrier.

Hydrophobic solvents are also suitable for use in the present compositions include, but are not limited to volatile silicones, branched chain hydrocarbons and mixtures thereof. Hydrophobic branched chain hydrocarbons useful as the volatile, hydrophobic solvent herein include, but are not limited to, those containing from about 7 to about 14, more preferably from about 10 to about 13, and most preferably from about 11 to about 12 carbon atoms. Saturated hydrocarbons are preferred, although it is not intended to exclude unsaturated hydrocarbons. Examples of such preferred branched chain hydrocarbons include isoparaffins of the above chain sizes. Specific examples of isoparaffins include Isopar E ($C_8$–$C_9$ isoparaffins), Isopar H and K ($C_{11}$–$C_{12}$ isoparaffins), and Isopar L ($C_{11}$–$C_{13}$ isoparaffins) or mixtures thereof (all commercially available form Exxon Chemical Co.) Other suitable branched chain hydrocarbons are isododecane and isohexadecane. Isododecane is preferred and is commercially available from Presperse, Inc. as Permethyl™ 99A.

Preferred silicones useful as the volatile hydrophobic solvent include, but are not limited to, volatile siloxanes such as phenyl pentamethyl disiloxane, phenylethylpentamethyl disiloxane, hexamethyl disiloxane, methoxy propylheptamethyl cyclotetrasiloxane, chloropropyl pentamethyl disiloxane, hydroxypropyl pentamethyl disiloxane, octamethyl cyclotetrasiloxane, decamethyl cylcopentasiloxane, and mixtures thereof. More preferred among the volatile silicones are hexamethyldisiloxane and cyclomethicones, examples of which include octamethyl cyclo tetrasiloxane and decamethyl cyclopentasiloxane, which are commonly referred to as D4 and D5 cyclomethicone, respectively.

Additional examples of preferred volatile silicones, include, but are not limited to, cyclopentasiloxane (commercially available from General Electric Co. as SF1202), hexylmethicone (commercially available from Archimica as Silcare 41M10), caprylil methicone (commercially available from Archimica as Silcare 41M15), stearoxytrimethylsilane and mixtures thereof.

Optional Components

In addition to the components described above, the compositions (active agent+carrier) of the present invention may further comprise one or more optional components known or otherwise effective for use in hair care or personal care products, provided that the optional components are physically and chemically compatible with the components described above, or do not otherwise unduly impair product stability, aesthetics or performance. Nonlimiting examples of such optional components are disclosed in *International Cosmetic Ingredient Dictionary*, Fifth Edition, 1993, and *CTFA Cosmetic Ingredient Handbook*, Second Edition, 1992, both of which are incorporated by reference herein in their entirety.

The compositions of the invention can contain adjuvants that are common in the cosmetics field, such as emulsifiers; surfactants; conditioning actives (moisturizers; emollients); sunscreens; anti-free-radical agents; sequestering agents; antioxidants; preserving agents; acidifying or basifying agents; fragrances; dyestuffs; modified or non-modified, non-volatile silicones; reducing agents. The amounts of these various adjuvants are those used conventionally in the fields considered.

The present invention may, in some embodiments, further comprise additional optional components known or otherwise effective for use in hair care or personal care products. The concentration of such optional ingredients generally ranges from zero to about 25%, more typically from about 0.05% to about 25%, even more typically from about 0.1% to about 15%, by weight of the composition. Such optional components should also be physically and chemically compatible with the essential components described herein, and should not otherwise unduly impair product stability, aesthetics or performance.

Methods of Manufacture

The compositions of the present invention may be prepared by any known or otherwise effective technique, suitable for providing a composition provided that the resulting composition provides the excellent styling benefits described herein. Methods for preparing the embodiments of the present invention include conventional formulation and mixing techniques.

The hair styling device of the present invention may be prepared by any known or otherwise effective technique, suitable for providing a device that provides the excellent styling benefits described herein. Methods for preparing the embodiments of the present invention include conventional manufacture techniques. As a further embodiment of the present invention, materials which may be used in the manufacturing process of the hair styling device include, but are not limited to: PET: heat-resistant plastic, PET may be used for example in an external housing; PC: heat-resistant plastic and transparent plastic, PC may be used for example in a reservoir case; PPS: heat-resistant plastic and chemical-resistant plastic, PPS may be used for example in a chamber case; and ABS: shock-resistant plastic, ABS may be used for example in external parts of a device. As may be known in the art, with regard to heat-resistance, PPS has the highest heat resistance for plastic and the subsequent order would be PPS>PET>PC>ABS. The embodiments of the present invention may use the appropriate and suitable plastic as needed.

Non-limiting exemplary embodiments of the hair styling device of the present invention may comprise a hair styling device that may be from about 200–300 mm in length and from about 10–40 mm in height per gripping means and about 45–75 mm in width.

Methods of Use

The present invention comprises a method for straightening hair wherein hair to be straightened is passed under tension between a gripping means, wherein the gripping means provides a heating means, and a styling active comprising nonvolatile compounds, wherein the styling active is delivered as droplets. In an further embodiment, the present invention may comprise a method for straightening hair strands on a user's scalp region comprising, in the presence of heat and a nonvolatile styling active delivered as droplets having a Dv(90) of less than about 30 microns slidably gripping the hair strands between the gripping means of the hair styling device of the present invention, placing the hair strands under tension by drawing the device along the strands in a direction away from the scalp region; releasing the hair strands and optionally repeating steps (a) and (b).

EXAMPLES

The following examples further describe and demonstrate embodiments within the scope of the present invention. The examples are given solely for the purpose of illustration and are not to be construed as limitations of the present invention, as many variations thereof are possible without departing from the spirit and scope of the invention. All exemplified concentrations are weight percents, unless otherwise specified.

Examples I–VIII

The following Examples I–VIII describe compositions of the present invention. Each of the exemplified compositions are prepared by combining all of the listed components and mixing the combination until homogeneous. The resultant liquid mixture is then filled into the reservoir container, and loaded into the device. Each of the exemplified hair compositions provides improved smooth and straight benefits that last longer.

| Component: | Example I | Example II | Example III | Example IV |
|---|---|---|---|---|
| Distilled Water | qs | qs | qs | qs |
| PEG-8[1] | 5.0 | | | |
| PEG-12[2] | 10.0 | 7.5 | — | — |
| PEG-20[3] | 2.0 | — | — | — |
| Ethanol (Denatured) | — | 10.0 | 5.0 | — |
| Polydimethylsiloxane (350 cs)[4] | | | 5.0 | |
| Silicone-Polyether Copolymer[5] | — | — | — | 2.0 |
| Sodium Cocoyl Isethionate | — | — | — | — |
| Glycereth-12[6] | — | — | 1.0 | 5.0 |
| Poloxamer 184[7] | — | — | 5.0 | — |
| PEG-12 Laurate[8] | | | | 5.0 |
| Lauramide DEA | 0.25 | — | — | 0.50 |
| Cocamidopropyl Betaine | 0.50 | — | — | — |
| Isostearetn-20 | — | 1.0 | 1.0 | 0.30 |
| Phenoxyethanol | 0.30 | 0.30 | 0.30 | 0.30 |
| Disodium EDTA | 0.12 | 0.12 | 0.12 | — |
| Benzyl Alcohol | 0.50 | 0.50 | 0.50 | 0.5 |
| Methyl Paraben | 0.20 | 0.20 | 0.20 | — |
| Perfume | 0.10 | 0.20 | 0.10 | 0.10 |

[1]Carbowax 400 available from Union Carbide
[2]Carbowax 600 available from Union Carbide
[3]Carbowax 900 available from Union Carbide
[4]SF96-350 available from General Electric
[5]Silwet L-77 available from Witco
[6]Unipeg ETG-12 from UPI
[7]Pluronic L-64 from BASF
[8]Lipogel 6-L from Lipo

| Component: | Example V | Example VI | Example VII | Example VIII |
|---|---|---|---|---|
| Distilled Water | qs | qs | qs | — |
| $C_{11}$—$C_{13}$ isoparaffins[9] | — | — | — | qs |
| Ethanol (Denatured) | 10.0 | — | — | 20.0 |
| PEG-12[2] | 2.5 | 5.0 | — | — |
| Oleth-5[10] | 5.0 | — | — | — |
| PPG-26[11] | — | — | — | 7.0 |
| Lauric/Palmitic/Oleic Tryglyceride | — | — | — | 2.0 |
| Triglycerin | — | — | 2.0 | — |
| Glycerin | — | — | 3.0 | — |
| Dimethicone PEG-7 Cocoate[12] | | 5.0 | — | — |
| Steartrimonium Chloride | — | — | 0.30 | — |
| Ditallowdimonium Chloride | 0.50 | — | — | — |
| PEG-10 Oleate[13] | — | 0.50 | 1.0 | — |
| PEG-8 Diisostearate[14] | — | — | — | 1.0 |
| Benzyl Alcohol | 0.50 | — | — | 0.50 |
| Phenoxyethanol | — | 0.3 | — | — |
| Disodium EDTA | — | — | 0.09 | — |
| Perfume | 0.15 | 0.05 | — | — |

[9]Isopar L from Exxon Mobil
[10]Volpo-5 from Croda
[11]Unicol P-2000 from UPI
[12]Ultrasil SW-12 from Noveon
[13]Ethofat 0/20 from Akzo
[14]PEG 400 Diisostearate from Scher Examples I–VII can work with either 1 or two reservoirs per side of styling device.

Example VIII may require two reservoirs per side of styling device.

The compositions illustrated in Examples I to VII illustrate specific embodiments of the present invention, but are not intended to be limiting thereof.

All exemplified compositions can be prepared by conventional formulation and mixing techniques. Component amounts are listed as weight percents and exclude minor materials such as diluents, filler, and so forth. The listed formulations, therefore, comprise the listed components and any minor materials associated with such components.

Having shown and described various embodiments of the present invention, further adaptations of the present invention as described herein can be accomplished by appropriate modifications by one of ordinary skill in the art without departing from the scope of the present invention. Several of these potential modifications and alternatives have been mentioned, and others will be apparent to those skilled in the art. For example, while exemplary embodiments of the inventive system have been discussed for illustrative purposes, it should be understood that the elements described may be constantly updated and improved by technological advances. Accordingly, the scope of the present invention should be considered in terms of the following claims and is understood not to be limited to the details of structure, operation or process steps as shown and described in the specification and drawings.

All documents cited in the Detailed Description of The Invention are, are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hair styling device for smoothing and straightening hair strands on a scalp region, comprising, in combination:

a) two hingedly attached, movably opposed arms each of said arms comprising a hair strand gripping means;

b) heating means incorporated into the gripping means for providing heat to the hair stands;

c) a reservoir in fluid communication with a means of delivery of the gripping means which delivers a nonvolatile styling active delivered as droplets having a Dv(90) of less than about 30 microns.

2. A hair styling device according to claim 1 wherein the reservoir additionally is comprised of water delivered to the hair.

3. A hair styling device according to claim 2 wherein about 0.02 to about 4 grams per minute of water is delivered to the hair.

4. A hair styling device according to claim 1 wherein the hair styling device further comprises a second reservoir.

5. A hair styling device according to claim 4 wherein the second reservoir comprises water.

6. A hair styling device according to claim 5 wherein about 0.02 to about 4 grains per minute of water is delivered to the hair.

7. A hair styling device according to claim 2 wherein the gripping means is comprised of opposing jaws of the device.

8. A hair styling device according to claim 2 wherein the gripping means comprises of a reservoir for containing the nonvolatile styling active.

9. A hair styling device according to claim 1 the reservoir is in fluid communication with the hair strands through one or more of the gripping means.

10. A hair styling device according to claim 1 wherein the reservoir resides in the arms.

11. A hair styling device according to claim 1 wherein the reservoir comprises a removable pre-filled cartridge.

12. A hair styling device according to claim 1 wherein the reservoir is refillable through a first exclusive joint.

13. A hair styling device according to claims 3 or 6 wherein the reservoir is in communication with a means of delivery of the styling active.

14. A hair styling device according to claim 13 wherein a means of transport connects the reservoir and the means of delivery of the styling active to the hair.

15. A hair styling device according to claim 14 wherein the means of transport is a material that is capable of wicking the nonvolatile styling active.

16. A hair styling device according to claim 15 wherein the means of transport is selected from the group consisting of a felt, foam, or a bundle of fibers.

17. A hair styling device according to claim 16 wherein the means of transport is a felt.

18. A hair styling device according to claim 3 wherein the nonvolatile styling active further comprises a carrier.

19. A hair styling device according to claim 18 wherein the nonvolatile styling active is miscible/dispersible in the carrier.

20. A hair styling device according to claims 1 or 19 wherein the nonvolatile styling active remains as a liquid or a semisolid after the styling active has been delivered to the hair.

21. A hair styling device according to claim 19 wherein the means of delivery of the nonvolatile styling active to the hair further comprises a means for vaporizing the cater resulting in a droplet size having a Dv(90) of less than about 30 microns.

22. A hair styling device for smoothing end straightening hair strands on a scalp region, comprising, in combination:

a) two hingedly attached, movably opposed arms, each arm comprising a hair gripping means, one or both of the gripping means being heatable;

b) a means of vaporization comprising a heatable vaporizing plate associated with one or both of the arms, the means of vaporization being in fluid communication with the gripping means;

c) reservoir in fluid communication with one or both of the gripping means for containing a nonvolatile styling active and a carrier;

d) means, associated with the hair styling device, to transport a styling active from the reservoir to a means of vaporization;

e) heating chamber in communication with the means of vaporization f) electronics associated with the hair styling device; and g) a styling composition, contained within a reservoir, comprising a nonvolatile active and wherein the styling composition further comprises a volatile carrier further wherein the hair styling device will deliver a styling composition comprising a nonvolatile active delivered as droplets having a Dv (90) of less than about 30 microns.

23. A hair styling device according to claim 22 wherein the nonvolatile actives are miscible/soluble in the carrier.

24. A hair styling device according to claim 22 wherein the carrier is selected from the group consisting of water, organic solvents, hydrophobic solvents and mixtures thereof.

25. A hair styling device according to claim 24 wherein the carrier is water.

26. A hair styling device according to claim 22 wherein the nonvolatile active is selected from the group consisting of polyalkylene glycols, polyethylene/polypropylene glycol copolymers, alkoxy polyethylene glycols, polyalkylene glyceryl ethers, polyalkylene glycol ethers of fatty acids, polyalkylene glycol ether of aliphatic alcohols, polyalkylene glyceryl ester of fatty acids, polyalkylene glyceryl ether of aliphatic alcohols, glyceryl alkylates, glyceryl alkyl ethers, glycol alkylate, polyglycerols, polyglycerol esters, soluble/dispersible nonvolatile silicone copolyols, polydimethicone copolyol and mixtures thereof.

27. A hair styling device according to claim 26 wherein the nonvolatile active is a polyalkylene glycol having a number average molecular weight of from about 190 to about 1500 and from about 5 to about 35 repeating alkylene oxide radicals wherein each of the repeating alkylene oxide radicals has from about 2 to about 6 carbon atoms.

28. A hair styling device according to claim 27 wherein the polyalkylene glycol is selected from the group consisting of ethoxy polyethylene/polypropylene glycol copolymers, methoxy polyethylene/polypropylene glycol copolymers, propoxy polyethylene/polypropylene glycol copolymers, butoxy polyethylene/polypropyleneglycol copolymers, pentoxy polyethylene/polypropylene glycol copolymers, triglycerin, hexaglycerin, PPG-4, PPG-6, PEG-5, PEG-6, PEG-8, PEG-12, PEG-14, PEG-18, PEG-20, PEG-32, and mixtures thereof.

29. A hair styling device according to claim 28 wherein the polyethylene glycol has a number average molecular weight of from about 400 to about 1000.

30. A hair styling device according to claim 22 wherein the means to transport a styling active from the reservoir to the heating chamber is a felt.

31. A hair styling device according to claim 30 wherein the felt is any porous material capable of wicking a compositions.

32. A hair styling device according to claim 22 wherein the felt has a contact area of about 10 to about 4000 $mm^2$ with the heating means.

33. A hair styling device according to claim 32 wherein the felt is comprised of a coarse filter.

34. A hair styling device according to claim 22 wherein the reservoir is further comprised of a valve that opens when a vacuum between about 2 to about 10 mmHg.

35. A hair styling device according to claim 22 wherein a delivery rate from the beating chamber is about 0.1 g/min to about 4 grams per minute.

36. A hair styling device according to claim 22 wherein the heating chamber has multiple row of holes for dispensing the styling composition.

37. A hair styling device according to claim 22 wherein the heating means is heated to a temperature range of 90° C. to about 210° C.

38. A hair styling device according to claim 22 wherein the device has a second reservoir.

39. A hair styling device according to claim 38 wherein the second reservoir comprises water.

40. A hair styling device according to claim 22 wherein the reservoir is capable of delivering the styling active when the device is orientated in any direction.

41. A composition of matter for use in a hair care operation, comprising a non-volatile compound and a carrier, the composition being releasably held within a reservoir, the reservoir comprising fluid-impermeable walls, the walls having an attachment means associated therewith for removably attaching the reservoir to a hair styling device, wherein the reservoir is in fluid communication with the hair styling device according to claims 1, 2 or 4.

42. A composition of matter for use in a hair care operation according to claim 41 wherein the reservoir is re-fillable.

43. A composition of matter for use in a hair care operation according to claim 41 wherein the reservoir is non-refillable.

44. A method for straightening hair strands on a user's scalp region comprising, in the presence of heat and a nonvolatile styling active delivered as droplets having a Dv(90) of less than about 30 microns:

a) gripping the hair strands between the gripping means of the hair styling device of claim 1;

b) placing the hair strands under tension by drawing the device along the strands in a direction away from the scalp region;

c) releasing the hair strands and optionally repeating steps (a) and (b).

45. A method according to claim 44 wherein the gripping means further provides about 0.02 to about 4 grams per minute of water.

46. A method according to claim 44 wherein the gripping means is comprised of jaws of a gripping device.

47. A method according to claim 46 wherein the jaws are hingedly connected to provide a unitary gripping device.

48. A method according to claim 44 further wherein a means of transport connects the reservoir and the means of delivery of the styling active to the hair.

49. A method according to claim 48 wherein the means of transport is a felt.

50. A method according to claim 44 wherein the styling active further comprises a carrier.

51. A method according to claim 50 wherein the styling active is miscible/dispersible in a carrier.

52. A method according to claim 51 wherein the means of delivery of the styling active to the hair further comprises a means for vaporizing the styling composition resulting in a droplet size having a Dv(90) of less than about 30 microns.

53. A method according to claim 52 wherein the nonvolatile compounds remain on the hair as a liquid or a semisolid after the styling active has been delivered to the hair.

* * * * *